US007369667B2

(12) United States Patent
Yamada

(10) Patent No.: US 7,369,667 B2
(45) Date of Patent: May 6, 2008

(54) ACOUSTIC IMAGE LOCALIZATION SIGNAL PROCESSING DEVICE

(75) Inventor: Yuji Yamada, Tokyo (JP)

(73) Assignee: Sony Corporation (JP)

( * ) Notice: Subject to any disclaimer, the term of this patent is extended or adjusted under 35 U.S.C. 154(b) by 816 days.

(21) Appl. No.: 10/257,217

(22) PCT Filed: Feb. 7, 2002

(86) PCT No.: PCT/JP02/01042

§ 371 (c)(1),
(2), (4) Date: Jan. 27, 2003

(87) PCT Pub. No.: WO02/065814

PCT Pub. Date: Aug. 22, 2002

(65) Prior Publication Data

US 2004/0013278 A1 Jan. 22, 2004

(30) Foreign Application Priority Data

Feb. 14, 2001 (JP) ..... 2001-37426

(51) Int. Cl.
*H04R 5/02* (2006.01)

(52) U.S. Cl. ..... 381/309; 381/310

(58) Field of Classification Search ..... 381/309, 381/310, 17, 1, 26, 18
See application file for complete search history.

(56) References Cited

U.S. PATENT DOCUMENTS 5,598,478 A * 1/1997 Tanaka et al. ..... 381/17
5,844,816 A * 12/1998 Inanaga et al. ..... 702/145
6,108,430 A * 8/2000 Kurisu ..... 381/310
6,498,857 B1 * 12/2002 Sibbald ..... 381/310

FOREIGN PATENT DOCUMENTS

JP 4-30700 A 2/1992
JP 4-56600 A 2/1992
JP 6-133400 A 5/1994
JP 6-285258 A 10/1994

* cited by examiner

*Primary Examiner*—Xu Mei
(74) *Attorney, Agent, or Firm*—Lerner, David, Littenberg, Krumholz & Mentlik, LLP

(57) ABSTRACT

An acoustic image localization signal processing device capable of localizing an acoustic image in an arbitrary direction includes: a sound source data storage unit that stores second sound source data obtained by subjecting first sound source data to signal preprocessing in advance, such that the acoustic image is localized in a predetermined direction; and an acoustic image localization characteristic application processing unit that applies an acoustic image localization position characteristic, based on position information from an acoustic image control input unit, to the second sound source data, when the second sound source data are read from the sound source data storage unit and reproduced by headphones. Accordingly, the acoustic image localization position of the reproduced output signals resulting from the second sound source data is controlled.

7 Claims, 11 Drawing Sheets

ACOUSTIC IMAGE LOCALIZATION SIGNAL PROCESSING DEVICE

TECHNICAL FIELD

This invention relates to an acoustic image localization signal processing device which, for example, performs processing of virtual sound source localization. More specifically, this invention relates to an audio reproduction system by means of headphones or speakers which is capable of effective acoustic image localization, with a simple configuration even when the virtual sound source to be reproduced is a moving sound source which moves as a result of listener's operations or similar.

BACKGROUND ART

Conventionally, there has been video game equipment (television game equipment), or the like, in which images are displayed on a television receiver, and these images are moved in response to instructions input by input means. Most of such game equipment has utilized a stereo sound field, reproduced by stereo audio output signals output from the game equipment main unit.

When reproducing such stereo audio output signals, for instance, a pair of speakers, positioned in front of and to the right and left of the listener (game player), may for example be used; these speakers may be incorporated into the television receiver. The reproduced acoustic images are normally localized only between the two speakers used as the reproduction means, and are not localized in other directions.

Further, when a listener listens to these stereo audio output signals using stereo headphones, the acoustic image remains confined within the listener's head, and the acoustic image does not coincide with the image displayed on the television receiver.

In order to improve such acoustic image localization by headphones, a method is conceivable which uses a headphone system including hardware configured to perform signal processing capable of reproducing the audio output signals of game equipment, with a sound field sensation equivalent to that of stereo reproduction using two stereo speakers on the left and right.

However, with this method it is possible to have the acoustic image come out from the head of the listener to the outside, and to reproduce audio output signals with a sound field sensation comparable to that of stereo speakers. But similarly to the reproduction by stereo speakers, the acoustic image is localized only between two virtual speaker positions, and localizing the acoustic image in other directions is not possible; also, expensive hardware is required in order to configure virtual sound sources.

Therefore, when reproducing audio in the conventional game equipment described above, even if the output is stereo audio output signals, when audio is reproduced by game equipment, there is a disadvantage that normally an acoustic image is localized only between the two reproducing speakers, and is not localized in other directions.

Also, when listening to reproduced stereo audio output signals using stereo headphones, the acoustic image remains confined within the listener's head, and there is the problem that the acoustic image does not coincide with the image displayed on the television receiver.

Moreover, in a method which uses a headphone system comprising hardware which can perform signal processing to reproduce the audio output signals from game equipment, with a sound field sensation comparable to stereo reproduction using two stereo speakers on the right and left, it is possible to have the acoustic image come out from the listener's head, and to reproduce signals with a sound field sensation comparable to that provided by stereo speakers; but similarly to the reproduction by stereo speakers, the acoustic image is only localized between the positions of two virtual speakers, and localizing the acoustic image in other directions is not possible; moreover, there is further the problem that expensive hardware is necessary to configure the virtual sound source.

DISCLOSURE OF THE INVENTION

Accordingly, an object of the present invention is to provide an acoustic image localization signal processing device capable of localizing an acoustic image in an arbitrary direction by means of a simple configuration.

An acoustic image localization signal processing device of this invention comprises: a sound source data storage unit, which stores a second sound source data set obtained by performing signal processing on a first sound source data set such that an acoustic image is localized in a reference direction or reference position; localization information control means, which provides instructions to the above reference direction or reference position to modify the acoustic image localization direction or the acoustic image localization position of the above first sound source data set; and acoustic image localization characteristic application means, which applies acoustic image localization characteristics to the above second sound source data set read from the above sound source data storage unit, based on the acoustic image localization direction or acoustic image localization position provided by the above localization information control means; and in which the acoustic image localization position with respect to the reproduced output signal resulting from the second sound source data set is controlled.

As a result, the following operation is performed according to the present invention.

In this acoustic image localization signal processing device, a sound source data set obtained through convolution computation with impulse responses using a digital filter as advance predetermined preprocessing is stored as a file or other data on recording media, and acoustic image localization characteristic application processing is performed by the acoustic image localization characteristic application processing unit, through control signals from an acoustic image localization position control processing unit under instructions from an acoustic image control input unit with respect to the sound source data set.

Further, an acoustic image localization signal processing device of this invention comprises: a sound source data storage unit, which stores a plurality of second sound source data sets obtained by performing signal processing on a first sound source data set such that acoustic images are localized in a plurality of different directions or positions; localization information control means, which provides localization information representing the acoustic image localization direction or acoustic image localization position of the above first sound source data set; acoustic image localization characteristic application means, which applies acoustic image localization characteristics to the above second sound source data set read from the above sound source data storage means, based on the acoustic image localization direction or acoustic image localization position provided by the above localization information control means; and in which one of the above plurality of second sound source data sets is selected based on localization information provided by the above localization information control means, and to the selected second sound source data set an output signal is provided in which the acoustic image localization characteristic is applied by the above acoustic image localization characteristic application means, so that the acoustic image localization positions of the reproduced output signal resulting from the plurality of second sound source data sets are controlled.

As a result, the following operation is performed according to the present invention.

In this acoustic image localization signal processing device, the plurality of sound source data sets corresponding to different localization positions obtained through convolution computation of impulse responses using a digital filter as advance predetermined preprocessing are stored as files or other data on recording media, and the sound source data set closest to the acoustic image localization position is selected from among the above sound source data sets through control signals from an acoustic image localization position control processing unit under instructions from an acoustic image control input unit, so that acoustic image localization characteristic application processing is performed on the selected sound source data set by the acoustic image localization characteristic application processing unit.

Further, an acoustic image localization signal processing device of this invention comprises: a sound source data storage unit, which stores a plurality of second sound source data sets obtained by performing signal processing on a first sound source data set such that acoustic images are localized in a plurality of different directions or positions; localization information control means, which provides localization information representing the acoustic image localization direction or acoustic image localization position of the above first sound source data set; a plurality of acoustic image localization characteristic application means, which apply acoustic image localization characteristics to the above plurality of second sound source data sets respectively read from the above sound source data storage means, based on the acoustic image localization direction or acoustic image localization position provided by the above localization information control means; and a selection and synthesis processing unit, which selects or synthesizes output signals with acoustic image localization characteristics respectively applied by the above plurality of acoustic image localization characteristic application means, based on localization information provided by the above localization information control means; and in which the acoustic image localization positions of the reproduced output signals resulting from arbitrary second sound source data sets are controlled.

As a result, the following operation is performed according to the present invention.

In this acoustic image localization signal processing device, the plurality of sound source data sets corresponding to different localization positions obtained through convolution computation with impulse responses using a digital filter as advance predetermined preprocessing are stored as files or other data on recording media, and acoustic image localization characteristic application processing is performed by the acoustic image localization characteristic application processing unit, through control signals from an acoustic image localization position control processing unit under instructions from an acoustic image control input unit with respect to the above sound source data set.

In this acoustic image localization signal processing device of this invention comprises: a sound source data storage unit, which stores a second sound source data set obtained by performing signal processing on a first sound source data set such that an acoustic image is localized in a reference direction or reference position; localization information control means, which provides instructions to the above reference direction or reference position to modify the acoustic image localization direction or acoustic image localization position of the above first sound source data set; and an acoustic image localization characteristic application means, which applies acoustic image localization characteristics to the above second sound source data set read from the above sound source data storage means, based on the acoustic image localization direction or acoustic image localization position provided by the above localization information control means; and in which the acoustic image localization position of the reproduced output signal resulting from the above second sound source data set is controlled. A second pair of sound source data sets is prepared which has been subjected to advance processing with a pair of impulse responses convoluted on the first sound source data set which are the original sounds. By providing an acoustic image localization characteristic application processing unit which adds a time difference, level difference, or frequency characteristic or similar in response to an acoustic image localization position between the L and R channels of the second pair of sound source data sets, acoustic image localization can be performed in any arbitrary position, and there is no need to perform realtime convolution processing on the first sound source data set with the impulse response according to the acoustic image localization position. Simply by preparing a second sound source data set which has already been convoluted with a pair of impulse responses, a wide range of acoustic image movement can be realized, the volume of computation can be reduced dramatically. Further, since the impulse response data is used at the time when convoluted into the second sound source data set in advance, a large number of taps, for example from 128 to 2 k taps, can be used as the number of taps of the digital filter in the second sound source data generation unit, so that extremely high-quality acoustic image localization becomes possible. As a result, when for example applied to a headphone system, there is the advantage that an acoustic image is localized with producing both an excellent anterior-direction localization sensation, and an excellent sensation of distance.

Further, an acoustic image localization signal processing device of this invention comprises: a sound source data storage unit, which stores a plurality of second sound source data sets obtained by performing signal processing on a first sound source data set such that acoustic images are localized in a plurality of different directions or positions; localization information control means, which provides localization information representing the acoustic image localization direction or acoustic image localization position of the above first sound source data set; and an acoustic image localization characteristic application means, which applies acoustic image localization characteristics to the above plurality of second sound source data sets read from the above sound source data storage means, based on the acoustic image localization direction or acoustic image localization position provided by the above localization information control means; and in which one of the above plurality of second sound source data sets is selected based on localization information provided by the above localization information control means and output signal are provided in which acoustic image localization characteristics are applied by the above acoustic image localization characteristic application means to the selected second sound source data set. A plurality of pairs of second sound source data sets, in which a pair of impulse response data sets is convoluted into the first sound source data set in advance, are prepared; and by selecting a data set close to the position for acoustic image localization from among these data sets, and by providing an acoustic image localization characteristic application processing unit which adds a time difference, level difference, or frequency characteristic or similar in response to an acoustic image localization position between the outputs of the L and R channels of the selected second pair of sound source data sets, acoustic image localization can be realized in any arbitrary position, the need to perform realtime convolution processing with the impulse response can be eliminated, and moreover data close to the impulse response data at the acoustic image localization position can be selected and used, so that there is the advantage that the quality of the reproduced acoustic image can be improved.

Further, in an acoustic image localization signal processing device of this invention, configured as described above, processing to apply acoustic image localization position characteristics to the second sound source data set by the above acoustic image localization characteristic application means is time difference application processing, in which a time difference corresponding to the acoustic image localization position is applied to reproduced output signals resulting from the second sound source data set, so that convolution processing with impulse responses, which has been necessary for each movement position in the prior art, becomes unnecessary, and acoustic image movement can be realized using an extremely simple configuration.

Further, in an acoustic image localization signal processing device of this invention, configured as described above, processing to apply acoustic image localization position characteristics to the second sound source data set by the above acoustic image localization characteristic application means is level difference application processing, in which a level difference corresponding to the acoustic image localization position is applied to reproduced output signals resulting from the second sound source data set, so that impulse response convolution processing, which has been necessary for each movement position in the prior art, becomes unnecessary, and acoustic image movement can be realized using an extremely simple configuration.

Further, in an acoustic image localization signal processing device of this invention, configured as described above, processing to apply acoustic image localization position characteristics to the second sound source data set by the above acoustic image localization characteristic application means is frequency characteristic application processing, in which a frequency characteristic difference corresponding to the acoustic image localization position is applied to reproduced output signals resulting from the second sound source data set, so that impulse response convolution processing, which has been necessary for each movement position in the prior art, becomes unnecessary, and acoustic image movement can be realized using an extremely simple configuration.

Further, in an acoustic image localization signal processing device of this invention, configured as described above, processing to apply acoustic image localization position characteristics to a second sound source data set by the above acoustic image localization characteristic application means is processing in which at least two differences in characteristics among a time difference, level difference, and frequency characteristic difference corresponding to the acoustic image localization position are applied to reproduced output signals resulting from the second sound source data set, so that impulse response convolution processing, which has been necessary for each movement position in the prior art, becomes unnecessary, and acoustic image movement can be realized using an extremely simple configuration. Thus there is the advantage that, by performing optimal characteristic application processing in response to the sound source data, higher-quality acoustic image movement can be achieved.

Furthermore, an acoustic image localization signal processing device of this invention comprises: a sound source data storage unit, which stores a plurality of second sound source data sets obtained by performing signal processing on a first sound source data set such that acoustic images are localized in a plurality of different directions or positions; localization information control means, which provides localization information representing the acoustic image localization direction or acoustic image localization position of the above first sound source data set; an acoustic image localization characteristic application means, which applies acoustic image localization characteristics to the above plurality of second sound source data sets respectively read from the above sound source data storage unit, based on localization information provided by the above localization information control means; and a selection and synthesis processing unit, which selects or synthesizes output signals with acoustic image localization characteristics respectively applied by the above plurality of acoustic image localization characteristic application means, based on localization information provided by the above localization information control means; and in which the plurality of output signals output from each of the acoustic image localization characteristic application means are selected or synthesized by the above localization information control means according to the localization position by the above localization information control means, so that a plurality of pairs of second sound source data sets, obtained by convoluting the first sound source data set with a pair of impulse responses in advance are prepared, and an acoustic image localization characteristic application processing unit which applies a time difference, level difference, or frequency characteristic difference, or similar, is provided in response to the acoustic image localization position between the outputs of the L channel and R channel of each pair of second sound source data sets. Further, by subjecting these output signals to addition processing in response to the acoustic image localization position, acoustic image localization at an arbitrary position is realized; hence the volume of computations to perform convolution processing with impulse responses in realtime can be eliminated, and moreover data close to the impulse response in the acoustic image localization position can be selected and used, with the advantage that the quality of the reproduced acoustic image can be improved.

Further, in an acoustic image localization signal processing device of this invention, configured as described above, the above plurality of second sound source data sets have, at least, forward sound source data which localizes an acoustic image in front of the listener, and rear sound source data which localizes an acoustic image in the rear. By using the forward data when the acoustic image localization position is in front, and applying the characteristic by means of an acoustic image localization characteristic application processing unit, the acoustic image can be moved, and by using the rear data when the acoustic image localization position is in the rear, and applying the characteristic by means of the acoustic image localization characteristic application processing unit, the acoustic image can be moved; hence there is the advantage that satisfactory acoustic image movement can be realized using a small amount of data.

Further, in an acoustic image localization signal processing device of this invention, configured as described above, the processing to apply an acoustic image localization position characteristic to the second sound source data set by the above acoustic image localization characteristic application means is time difference application processing, in which a time difference corresponding to an acoustic image localization position is applied to the reproduced output signals resulting from the second sound source data set, so that convolution processing with impulse responses, which in the prior art has been necessary for each movement position, becomes unnecessary, and there is the advantage that acoustic image movement can be realized through an extremely simple configuration.

Further, in an acoustic image localization signal processing device of this invention, configured as described above, the processing to apply an acoustic image localization position characteristic to the second sound source data set by the above acoustic image localization characteristic application means is level difference application processing, in which a level difference corresponding to an acoustic image localization position is applied to the reproduced output signals resulting from the second sound source data set, so that convolution processing with impulse responses, which in the prior art has been necessary for each movement position, becomes unnecessary, and there is the advantage that acoustic image movement can be realized through an extremely simple configuration.

Further, in an acoustic image localization signal processing device of this invention, configured as described above, the processing to apply an acoustic image localization position characteristic to the second sound source data set by the above acoustic image localization characteristic application means is frequency characteristic difference application processing, in which a frequency characteristic corresponding to an acoustic image localization position is applied to the reproduced output signals resulting from the second sound source data set, so that convolution processing with impulse responses, which in the prior art has been necessary for each movement position, becomes unnecessary, and there is the advantage that acoustic image movement can be realized through an extremely simple configuration.

Further, in an acoustic image localization signal processing device of this invention, configured as described above, the processing to apply an acoustic image localization position characteristic to the second sound source data set by the above acoustic image localization characteristic application means is processing in which at least two differences in characteristics among a time difference, level difference, and frequency difference corresponding to the acoustic image localization position are applied to the reproduced output signals resulting from the second sound source data set, so that convolution processing with impulse responses, which in the prior art has been necessary for each movement position, becomes unnecessary, and there is the advantage that acoustic image movement can be realized through an extremely simple configuration. Thus, by performing optimal characteristic application processing in response to the sound source data, higher-quality acoustic image movement can be achieved.

Further, in an acoustic image localization signal processing device of this invention, configured as described above, addition processing means is provided which, when switching to another second sound source data set which is different from the selected second data set because the acoustic image has moved, adds and outputs the above second sound source data set prior to movement and the above other second sound source data set after movement near the switching boundary. By changing the addition ratio of the above second sound source data set and the above other second sound source data set, movement of the acoustic image is accomplished, so that when using acoustic image localization data in a plurality of directions to cause acoustic image movement, by using cross-fade processing to switch output between data sets having subjected to convolution processing with impulse responses in different acoustic image directions, there is the advantage that shock noises and unnatural sensations due to acoustic image movement between different data sets can be alleviated.

BEST MODE FOR CARRYING OUT THE INVENTION

An acoustic image localization signal processing device according to an embodiment of the present invention is configured such that in cases where a listener listens to reproduced sound by means of headphones or speakers, a second sound source data set subjected to advance signal processing to be recorded and stored, in which the original first sound source data set undergoes acoustic image localization in a reference direction or reference position with respect to the listener, is provided in file form; and a virtual sound source is localized in a position determined by listener operations or by a program corresponding to this second sound source data set. At the time of reproducing this second stereo sound source data, acoustic image localization characteristic application processing is performed to apply acoustic image localization position characteristics to the two-channel reproduction output, whereby the acoustic image localization position is controlled.

First, an acoustic image localization processing device which is a premise of this embodiment is explained.

Figure 3:
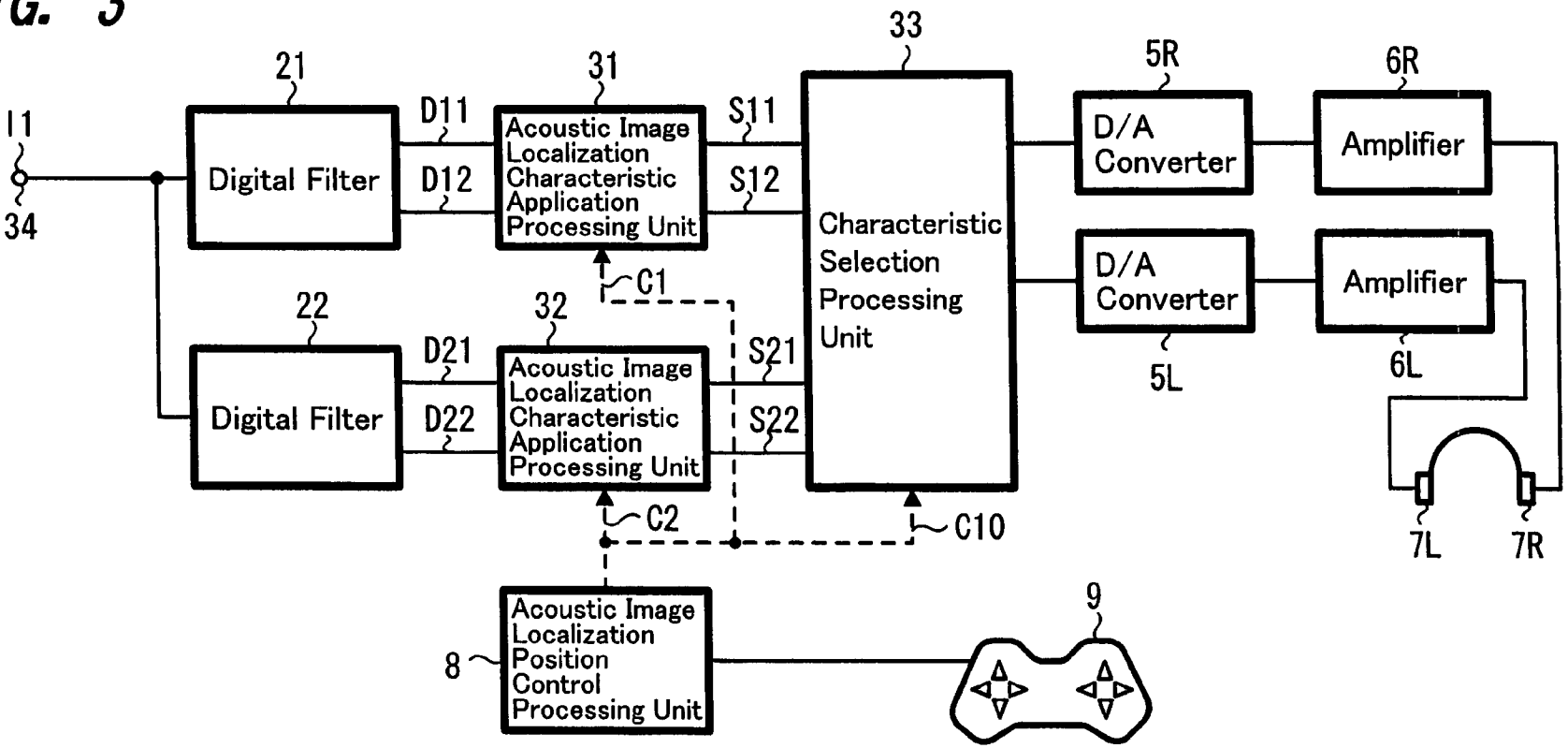
FIG. 3 is a block diagram showing the configuration of an assumed acoustic image localization processing device.

FIG. 3 is a block diagram showing the configuration of the assumed acoustic image localization processing device.

In FIG. 3, the input signal I1 is divided into two systems, which are input to digital filters 21, 22 respectively.

Figure 4:
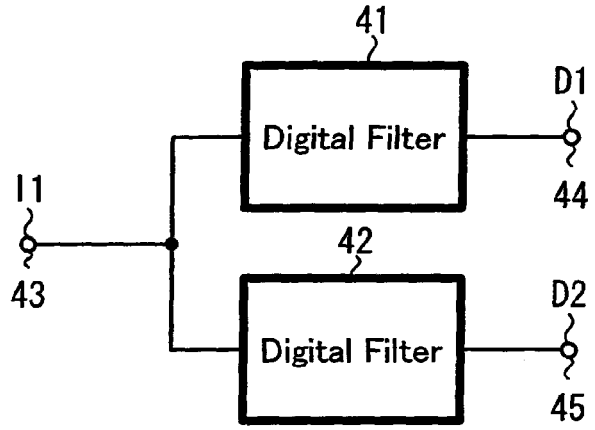
FIG. 4 is a diagram showing an example of the configuration of the second sound source data generation unit.

The digital filters 21, 22 shown in FIG. 3 are configured as shown in FIG. 4; a terminal 34 shown in FIG. 3 corresponds to a terminal 43 shown in FIG. 4, the digital filter 21 shown in FIG. 3 corresponds to digital filters 41, 42 shown in FIG. 4, the digital filter 22 shown in FIG. 3 corresponds to the digital filters 41, 42 shown in FIG. 4, the output side of the output signals D11, D21 shown in FIG. 3 corresponds to a terminal 44, and the output side of the output signals D12, D22 shown in FIG. 3 corresponds to the terminal 45.

Figure 6:
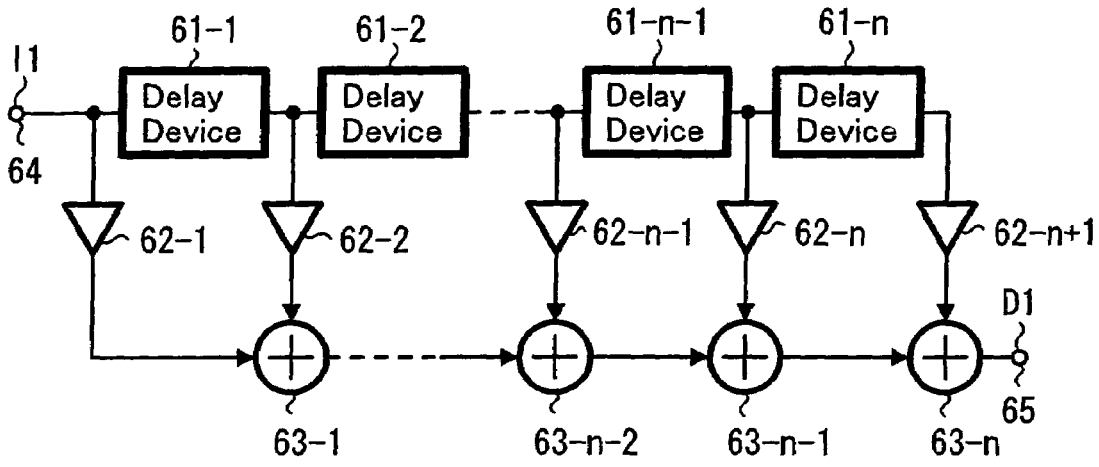
FIG. 6 is a diagram showing an example of the configuration of the FIR filter.

The digital filters 41, 42 shown in FIG. 4 are each configured from the FIR filter shown in FIG. 6. The terminal 43 shown in FIG. 4 corresponds to a terminal 64 shown in FIG. 6; the terminal 44 shown in FIG. 4 corresponds to a terminal 65 shown in FIG. 6; and a terminal 45 shown in FIG. 4 corresponds to the similar terminal 65 shown in FIG. 6. In FIG. 6, the FIR filter is configured to have delay devices 61-1 to 61-n, scalers 62-1 to 62-n+1, and adders 63-1 to 63-n. When a listener listens to reproduced audio using headphones, speakers or similar with an FIR filter, impulse response convolution processing is performed such that the acoustic image is localized in an arbitrary position in the vicinity of the listener, for example, in front of or behind the listener.

A function is explained as follows in which an acoustic image is localized in an arbitrary out-of-head position in the vicinity of the listener, generally when the listener is listening to reproduced audio using headphones.

Figure 15:
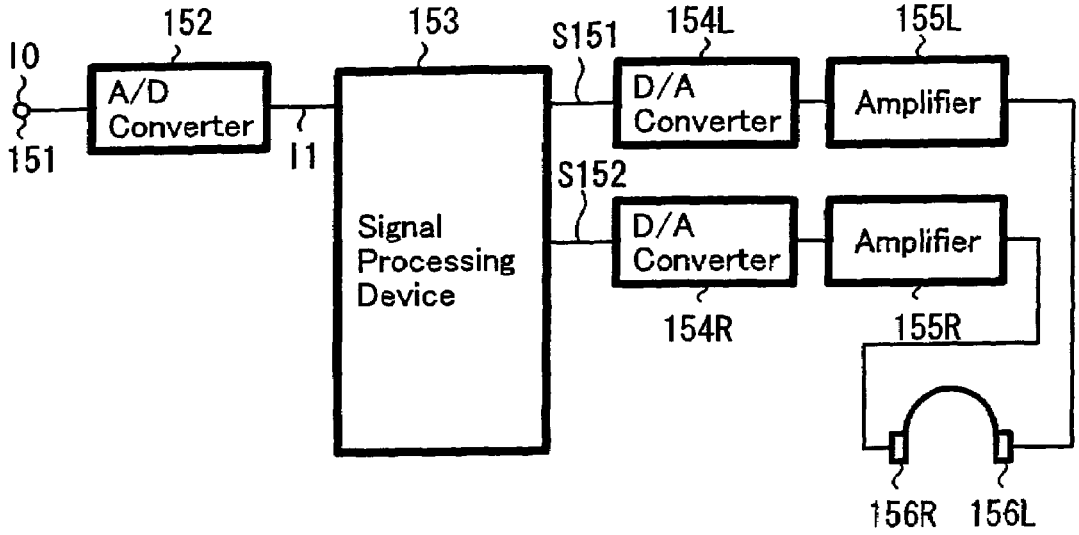
FIG. 15 is a diagram showing the configuration of a headphone device.
Figure 16:
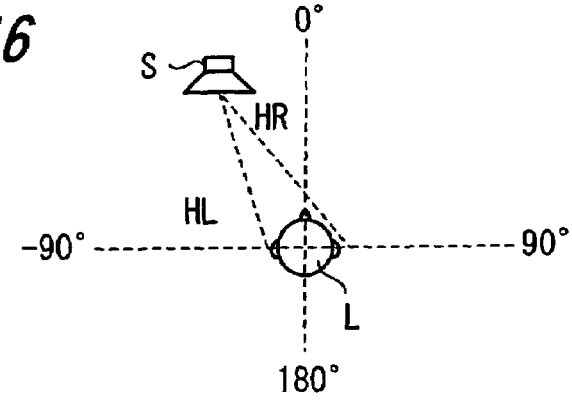
FIG. 16 is a diagram showing the principle of an out-of-head acoustic image localization type headphone device.

FIG. 15 is a diagram showing the configuration of a headphone device. This headphone device localizes an acoustic image in an arbitrary position outside the head of the listener. As shown in FIG. 16, by means of this headphone device, a state is reproduced in which the listener L listens to sounds reproduced according to the transfer functions (Head Related Transfer Functions) HL, HR from the speaker S to the left and right ears.

The headphone device shown in FIG. 15 includes a terminal 151 to which an input signal I0 is supplied; an A/D converter 152 which converts the input signal I0 into a digital signal I1; and a signal processing device 153 which executes filter processing (acoustic image localization processing) on the converted digital signal I1.

Figure 17:
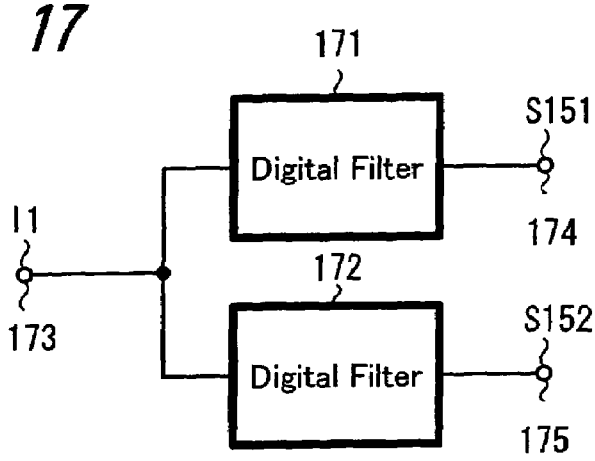
FIG. 17 is a diagram showing a signal processing device.

The signal processing device 153 shown in FIG. 15 comprises, for example, a terminal 173, digital filters 171, 172, and terminals 174, 175, as shown in FIG. 17; the input side of the input signal I1 shown in FIG. 15 corresponds to the terminal 173 shown in FIG. 17, the output side of the output signal S151 in FIG. 15 corresponds to the terminal 174, and the output side of the output signal S152 in FIG. 15 corresponds to the terminal 175.

Figure 18:
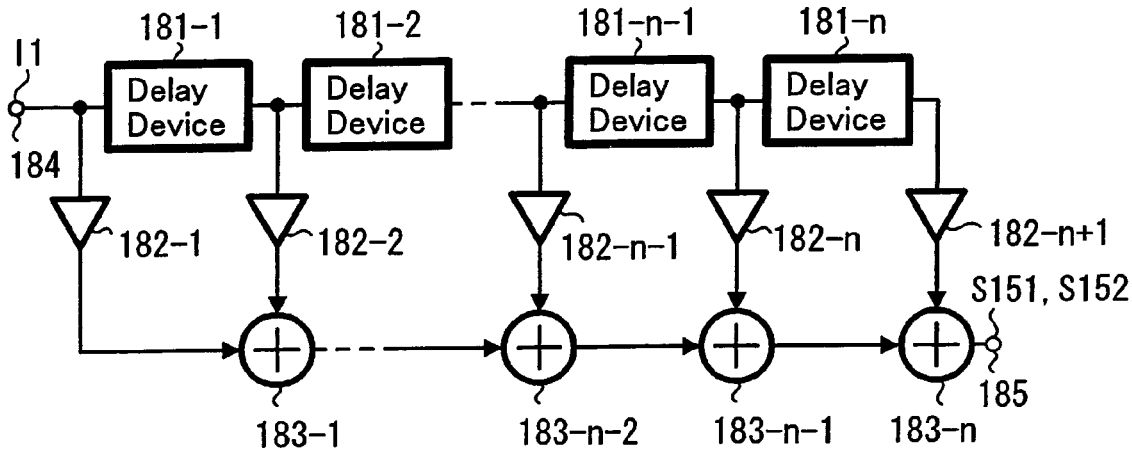
FIG. 18 is a diagram showing an example of the configuration of an FIR filter.

The digital filters 171, 172 in FIG. 17 each comprise FIR filters as shown in FIG. 18; the terminal 173 in FIG. 17 corresponds to a terminal 184 in FIG. 18, the terminal 174 in FIG. 17 corresponds to a terminal 185 in FIG. 18, and the terminal 175 in FIG. 17 corresponds to the similar terminal 185 in FIG. 18.

In FIG. 18, the FIR filter has the terminal 184, delay devices 181-1 to 181-n, scalers 182-1 to 182-n+1, adders 183-1 to 183-n, and the terminal 185.

With this configuration, in the digital filter 171 shown in FIG. 17, the impulse response resulting from conversion of the transfer function HL to the time domain is convoluted into the input audio signal I1, and the resulting left audio output signal S151 is generated. And in the digital filter 172 shown in FIG. 17, the impulse response resulting from conversion of the transfer function HR to the time domain is convoluted into the input audio signal I1, and the resulting right audio output signal S152 is generated.

Returning to FIG. 15, the headphone device has D/A converters 154L, 154R which convert the audio signals S151, S152 output by the signal processing device 153 into analog audio signals; amplifiers 155L, 155R which amplify the respective analog audio signals; and headphones 156L, 156R to which the amplified audio signals are supplied to perform acoustic reproduction.

The operation of a headphone device configured as such and shown in FIG. 15 is explained below.

After converting the input signal I0 input to the terminal 151 into a digital signal I1 by the A/D converter 152, the digital signal I1 is supplied to the signal processing device 153. In the digital filters 171, 172 shown in FIG. 17 within the signal processing device 153, the impulse responses resulting from conversion of the transfer functions HL, HR into the time domain are convoluted into the input signals I1 respectively, to generate the left audio output signal S151 and the right audio output signal S152.

The left audio output signal S151 and right audio output signal S152 are then converted into analog signals by the D/A converters 154L, 154R respectively to be supplied to the headphones 156L, 156R after amplification by the amplifiers 155L, 155R.

Hence the headphones 156L, 156R are driven by the left audio output signal S151 and right audio output signal S152, so that the acoustic image of the input signal I0 can be localized outside the head. That is, when the listener wears the headphones 156L, 156R on the head, a state is reproduced in which the sound source S of the reproduced audio of the transfer functions HL, HR is in an arbitrary position outside the head, as shown in FIG. 16.

Figure 19:
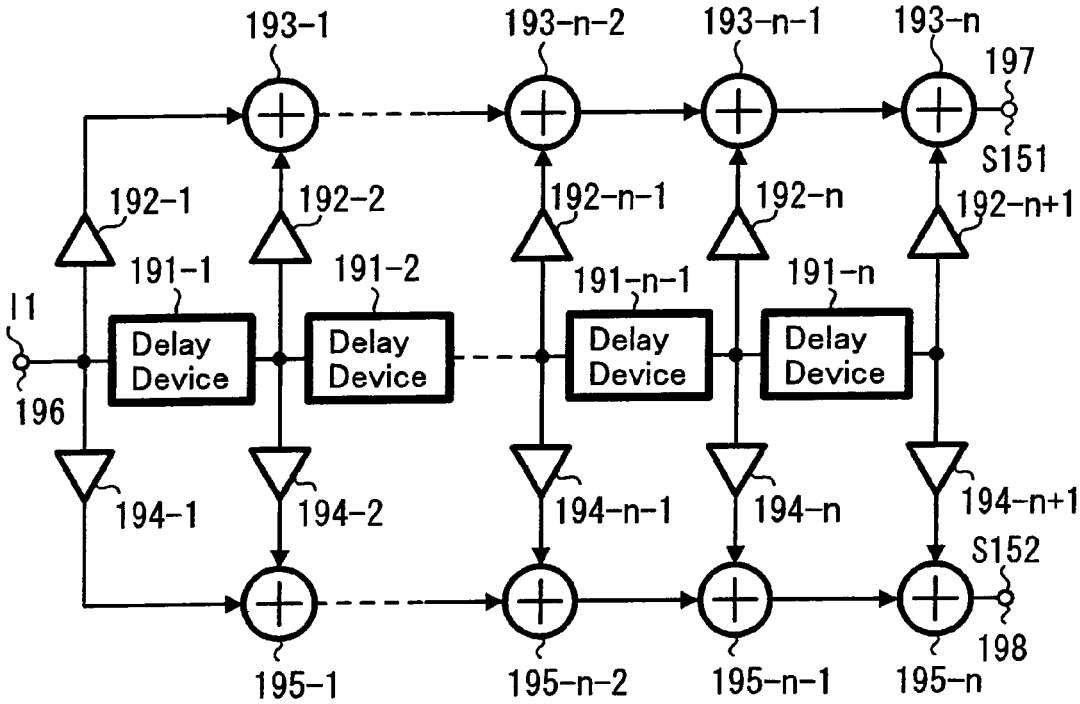
FIG. 19 is a diagram showing an example of the configuration of a digital filter; and, FIG. 20 is a diagram showing another signal processing device.

The delay devices 181-1 to 181-n of the two FIR filters shown in FIG. 18 comprised of the digital filter of FIG. 17 may be used in common, to configure a digital filter as shown in FIG. 19. In FIG. 19, the digital filter comprising the two FIR filters has a terminal 196, delay devices 191-1 to 191-n, scalers 192-1 to 192-n+1, adders 193-1 to 193-n, scalers 194-1 to 194-n+1, adders 195-1 to 195-n, and terminals 197, 198.

Figure 20:
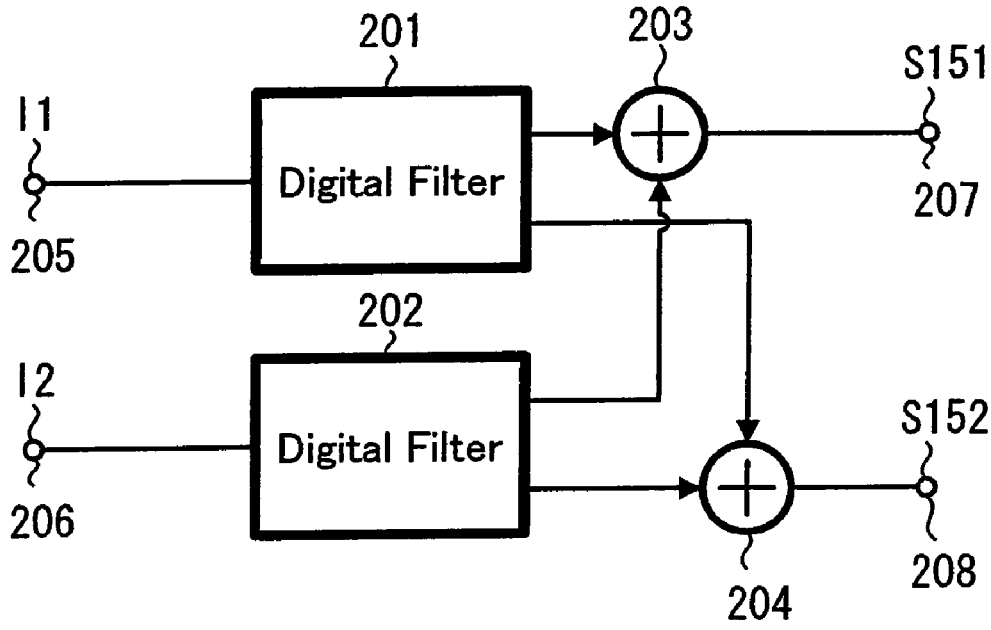

The signal processing device 153 shown in FIG. 15 may also be configured as shown in FIG. 20 with respect to a plurality of sound sources for which acoustic images are to be localized in different positions. In FIG. 20, another signal processing device is configured having terminals 205, 206, digital filters 201, 202, adders 203, 204, and terminals 207, 208.

In FIG. 20, when for example two input signals I1, I2 are provided to the terminals 205, 206 from a plurality of sound sources, the first output of a digital filter 201 and a first output of the other digital filter 202 are added by an adder 203 to obtain an output signal S151, and the second output of the other digital filter 202 and the second output of the former digital filter 201 are added by an adder 204 to obtain the output signal S152.

From the principle explained above, by performing convolution processing on the input signal with impulse response data from the sound source localization position to both the listener's ears, the digital filters 21, 22 shown in FIG. 3 can localize the acoustic image at an arbitrary position in the vicinity of the listener.

Here the digital filter 21 comprises a convolution computation unit which processes the impulse response corresponding to the sound source positioned in front of the listener, and the digital filter 22 comprises a convolution computation unit which processes the impulse response corresponding to the sound source positioned behind the listener.

Figure 7:
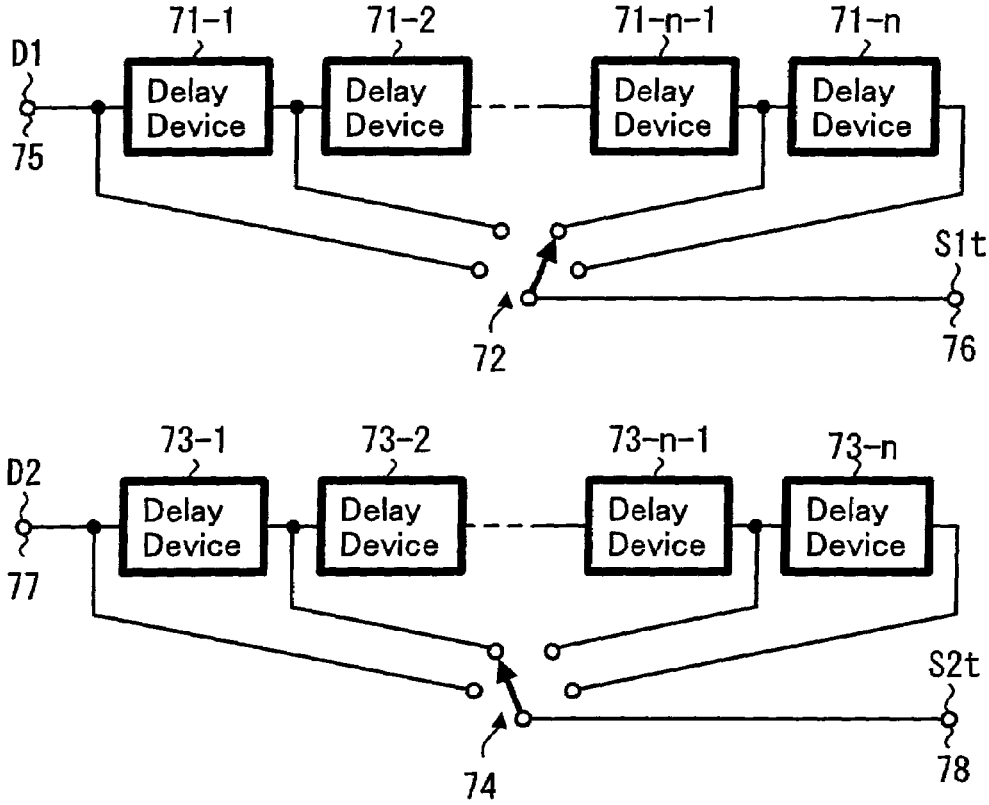
FIG. 7 is a diagram showing an example of the configuration of the time difference application processing unit.

The two outputs of the digital filters 21, 22 are input to acoustic image localization characteristic application processing units 31, 32. Examples of the configuration of the acoustic image localization characteristic application processing units 31, 32 are illustrated in FIG. 7. In FIG. 7, a time difference is applied to the two systems of input signals. The time difference application processing unit shown in FIG. 7 has a terminal 75, delay devices 71-1 to 71-n, a switch 72, a terminal 76, a terminal 77, delay devices 73-1 to 73-n, a switch 74, and a terminal 78.

The input signal D1 input to the terminal 75, is supplied to the delay devices 71-1 to 71-n, and according to the output from the delay devices 71-1 to 71-n selected by the switch 72, a time difference is applied to the input signal D1 to output signal S1*t* output from the terminal 76.

The input signal D2 input to the terminal 77, is supplied to the delay devices 73-1 to 73-n, and according to the output from the delay devices 73-1 to 73-n selected by the switch 74, a time difference is applied to the input signal D2 to output signal S2*t* output from the terminal 78.

Figure 12:
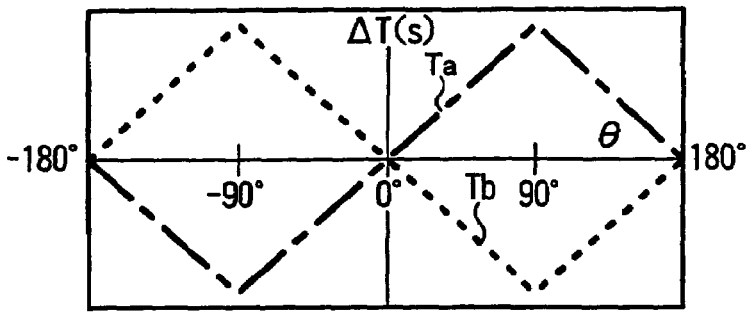
FIG. 12 is a figure showing the characteristic relating the head rotation angle and the time difference.

A time difference such as shown in FIG. 12 occurs in the signal from the sound source to both the listener's ears, according to the angle from the listener's anterior direction. In FIG. 12, the rotation angle 0° is the state in which the sound source S is positioned in front of the listener L in FIG. 16. In FIG. 16, if for example the sound source S is rotated by −90° in the left direction with respect to the listener L, then as shown by Ta, the arrival time of audio arriving at the right ear lags behind that arriving from the anterior direction; and as shown by Tb, the arrival time of audio arriving at the left ear is ahead of that arriving from the anterior direction, so that a time difference occurs between the two.

On the other hand, if the sound source S is rotated by +90° in the right direction with respect to the listener L, the arrival time of audio arriving at the right ear, as indicated by Ta, is ahead of that arriving from the anterior direction, and as indicated by Tb, the arrival time of audio arriving at the left ear lags behind that arriving from the anterior direction, so that a time difference occurs between the two.

Returning to FIG. 3, processing to generate and apply the time difference described above is performed on data convoluted with transfer functions, based on a control signal Cl from an acoustic image localization position control processing unit 8 resulting from instructions from an acoustic image control input unit 9. By applying this time difference, by means of the acoustic image localization characteristic application processing unit 31, to the stereo outputs D11, D12 from the digital filter 21 shown in FIG. 3, outputs S11, S12 can be obtained in which the acoustic image localization position in front of the listener has been approximately moved.

Similarly, by thus applying the time difference to the stereo outputs D21, D22 from the digital filter 22 shown in FIG. 3, by means of the acoustic image localization characteristic application processing unit 32, based on a control signal C2 from the acoustic image localization position control processing unit 8 resulting from instructions from the acoustic image control input unit 9, outputs S21, S22 can be obtained in which the acoustic image localization position behind the listener has been approximately moved.

By means of the control signal C10 from the acoustic image localization position control processing unit 8 resulting from instructions from the acoustic image control input unit 9, when the position in which the acoustic image is to be localized is in front of the listener, a characteristic selection processing unit 33 selects the outputs S11, S12 of the acoustic image localization characteristic application processing unit 31 to convert the outputs into analog signals by D/A converters 5R, 5L, and these are amplified by amplifiers 6R, 6L so that the listener can listen to sound reproduced by the headphones 7R, 7L. By this means, the acoustic image can be localized at an arbitrary position in front of the listener.

Also, by means of the control signal C10 from the acoustic image localization position control processing unit 8 resulting from instructions from the acoustic image control input unit 9, when the position in which the acoustic image is to be localized is behind the listener, the characteristic selection processing unit 33 selects the outputs S21, S22 of the acoustic image localization characteristic application processing unit 32, to convert the outputs into analog signals by the D/A converters 5R, 5L, and these are amplified by the amplifiers 6R, 6L so that the listener can listen to sound reproduced by the headphones 7R, 7L. By this means, the acoustic image can be localized at an arbitrary position behind the listener.

Figure 10:
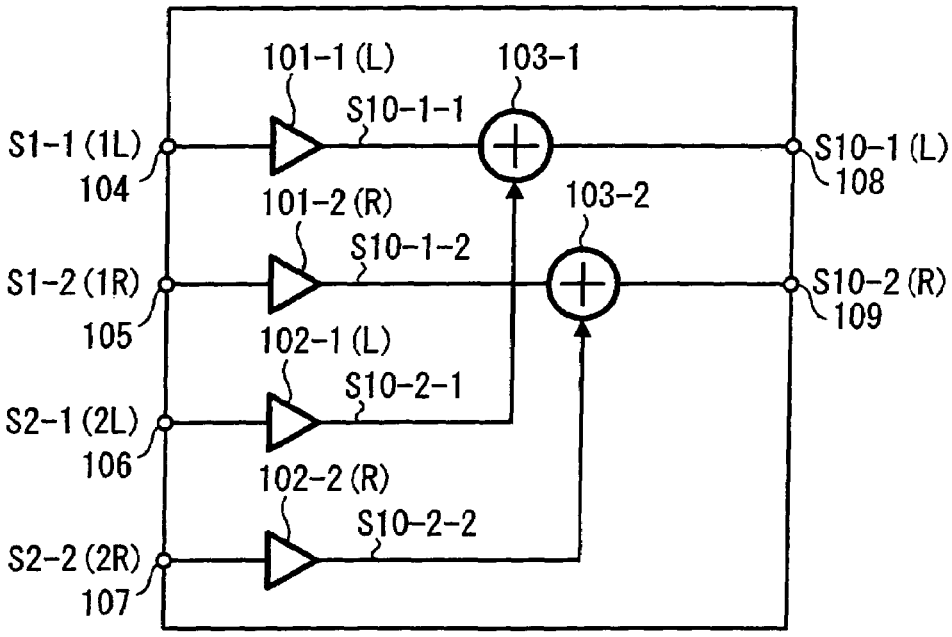
FIG. 10 is a diagram showing an example of the configuration of the characteristic selection processing unit.

The characteristic selection processing unit 33 shown in FIG. 3 can for example be configured as shown in FIG. 10.

In FIG. 10, the characteristic selection processing unit 33 has terminals 104, 105, to which the input signals S1-1, S1-2 are input; scalers 101-1, 101-2; adders 103-1, 103-2; terminals 106, 107, to which the input signals S2-1, S2-2 are input; scalers 102-1, 102-2; and terminals 108, 109 to which the output signals S10-1, S10-2 are output.

In FIG. 10, when the acoustic image localization position is in front of the listener, the coefficients of the scalers 101-1, 101-2 are set to 1, the coefficients of the scalers 102-1, 102-2 are set to 0, and only the input signals S1-1, S1-2 are output, without modification. On the other hand, when the acoustic image localization position is behind the listener, the coefficients of the scalers are controlled such that only the input signals S2-1, S2-2 are output, without modification. Further, when the acoustic image localization position is on one side of the listener, the coefficients are for example set to 0.5, and the input signals S1-1, S1-2, S2-1, S2-2 are mixed and output. When the sound source is on one side of the listener and is moving in an anterior-posterior direction (or in a circumferential direction), the output signals S10-1-1, S10-

1-2 of the scalers 101-1, 101-2 are gradually diminished, while the output signals S10-2-1, S10-2-2 of the scalers 102-1, 102-2 are gradually increased, while on the other hand the output signals S10-1-1, S10-2-1 of the scalers 101-1, 101-2 are gradually increased, and the output signals S10-2-1, S10-2-2 of the scalers 102-1, 102-2 are gradually decreased; thus by performing cross-fade processing, smooth data switching can be performed even when the acoustic image moves between a plurality of sound source localization positions obtained by the respective acoustic image localization characteristic application processing.

As explained above, by means of the assumed acoustic image localization processing device shown in FIG. 3, through realtime signal processing in the digital filters 21, 22 and the acoustic image localization characteristic application processing units 31, 32, the acoustic image of the input signal I1 can be localized at an arbitrary position in the vicinity of the listener.

In the above explanation, the time difference application processing unit shown in FIG. 7 was used as an example of the acoustic image localization characteristic application processing units 31, 32; but instead of the time difference application processing unit, a level difference application processing unit may be used.

Figure 8:
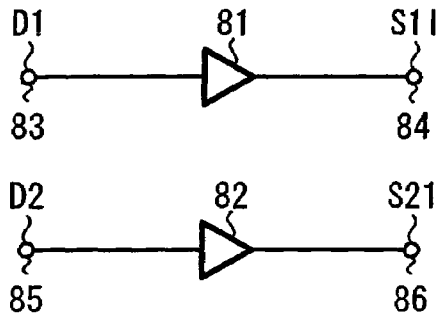
FIG. 8 is a diagram showing an example of the configuration of the level difference application processing unit.

The level difference application processing units can be configured as shown in FIG. 8. In FIG. 8, the level difference application processing units have a terminal 83, scaler 81, terminal 84, terminal 85, scaler 82, and terminal 86.

In FIG. 8, the level difference application processing unit updates the level in the scaler 81 with respect to the input signal D1 input from the terminal 83, based on the control signal C1 from the acoustic image localization position control processing unit 8 according to instructions from the acoustic image control input unit 9, and by this means, an output signal S1 with a level difference applied is obtained at the terminal 84. In this way, a level difference can be applied to the input signal D1.

Also, the level difference application processing unit updates the level in the scaler 82 with respect to the input signal D2 input from the terminal 85, based on the control signal C2 from the acoustic image localization position control processing unit 8 according to instructions from the acoustic image control input unit 9, and by this means, an output signal S21 with a level difference applied is obtained at the terminal 86. In this way, a level difference can be applied to the input signal D2.

Figure 13:
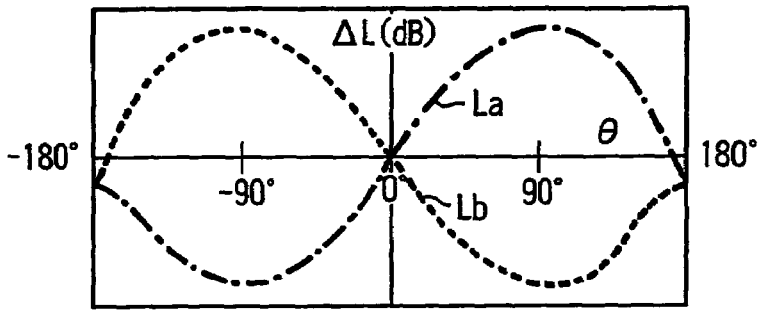
FIG. 13 is a figure showing the characteristic relating the head rotation angle and the level difference.

As shown in FIG. 16, in signals reaching both ears of the listener L from the sound source S, there is a level difference such as shown in FIG. 13 due to the angle from the anterior direction of the listener L, represented by 0°. In FIG. 13, the rotation angle 0° is the state in which the sound source S is positioned in front of the listener L in FIG. 16. In FIG. 16, if for example the sound source is rotated by −90° in the left direction with respect to the listener L, then as indicated by Lb, the level of sound arriving at the left ear is higher than that from the anterior direction, and the level of sound arriving at the right ear as indicated by La is lower than that from the anterior direction, so that a level difference occurs between the two.

On the other hand, if the sound source S rotates +90° in the right direction with respect to the listener L, the level of sound arriving at the left ear as indicated by Lb is lower than that from the anterior direction, the level of sound arriving at the right ear as indicated by La is higher than that from the anterior direction, and a level difference occurs between the two.

Returning to FIG. 3, processing to generate and apply the level difference described above is performed on data convoluted with transfer functions, based on a control signal C1 from the acoustic image localization position control processing unit 8 resulting from instructions from the acoustic image control input unit 9. By thus applying the level difference, by means of the acoustic image localization characteristic application processing unit 31, to the stereo outputs D11, D12 from the digital filter 21 shown in FIG. 3, outputs S11, S12 can be obtained in which the acoustic image localization position in front of the listener has been approximately moved.

Similarly, by thus applying the level difference, by means of the acoustic image localization characteristic application processing unit 32, to the stereo outputs D21, D22 from the digital filter 22 shown in FIG. 3, outputs S21, S22 can be obtained in which the acoustic image localization position behind the listener has been approximately moved.

In the above explanation, an example was described in which the level difference application processing unit shown in FIG. 8 is used as the acoustic image localization characteristic application processing units 31, 32; but in place of the level difference application processing unit, a frequency characteristic application processing unit may be used.

Figure 9:
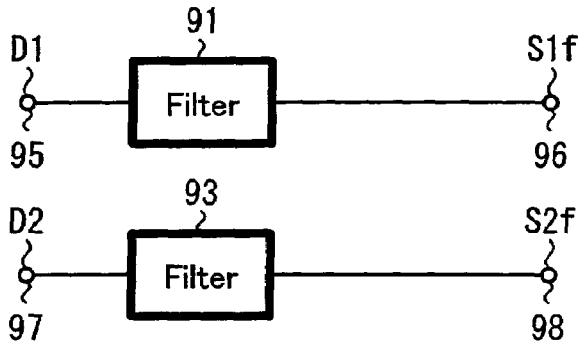
FIG. 9 is a diagram showing an example of the configuration of the frequency characteristic application processing unit.

The frequency characteristic application processing unit can be configured as shown in FIG. 9. In FIG. 9, the frequency characteristic application processing unit has a terminal 95, filter 91, terminal 96, terminal 97, filter 93, and terminal 98.

In FIG. 9, the frequency characteristic application processing unit updates the frequency characteristic of the filter 91, based on the control signal C1 from the acoustic image localization position control processing unit 8 according to instructions from the acoustic image control input unit 9, whereby a level difference is applied to the input signal D1 input to the terminal 95 only in a predetermined frequency band, to be output from the terminal 96 as the output signal S1*f*. In this way, a level difference can be applied to the input signal D1 only in a predetermined frequency band.

Also, the frequency characteristic application processing unit updates the frequency characteristic of the filter 93, based on the control signal C2 from the acoustic image localization position control processing unit 8 according to instructions from the acoustic image control input unit 9, whereby a level difference is applied to the input signal D2 input to the terminal 97 only in a predetermined frequency band, to be output from the terminal 98 as the output signal S2*f*. In this way, a level difference can be applied to the input signal D2 only in a predetermined frequency band.

Figure 14:
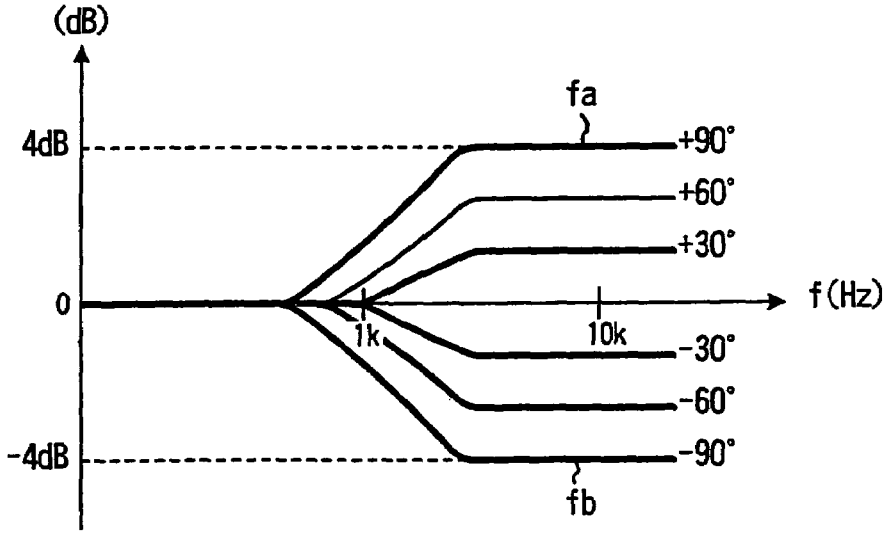
FIG. 14 is a figure showing the characteristic relating the head rotation angle and the frequency.

As shown in FIG. 16, in signals reaching both ears of the listener L from the sound source S, there is a level difference depending on the frequency band such as shown in FIG. 14, due to the angle from the anterior direction of the listener L, represented by 0°. In FIG. 14, the rotation angle 0° is the state in which the sound source S is positioned in front of the listener L in FIG. 16. In FIG. 16, if for example the sound source is rotated by −90° in the left direction with respect to the listener L, then as indicated by fa, the level difference in the sound arriving at the left ear is higher than that from the anterior direction, and the level of sound arriving at the right ear as indicated by fb is lower than that from the anterior direction. In particular a level difference occurs in the high-frequency band.

On the other hand, if the sound source S is rotated by +90° in the right direction with respect to the listener L, the level of sound arriving at the left ear as indicated by fb is lower than that from the anterior direction, the level of sound arriving at the right ear as indicated by fa is higher than that from the anterior direction, and a level difference occurs in the high-frequency band in particular.

Returning to FIG. 3, processing to generate and apply the level difference described above is performed on data convoluted with transfer functions, based on a control signal C1 from the acoustic image localization position control processing unit 8 resulting from instructions from the acoustic image control input unit 9. By thus applying the level difference, by means of the acoustic image localization characteristic application processing unit 31, to between the stereo outputs D11, D12 from the digital filter 21 shown in FIG. 3 only in the predetermined frequency band, outputs S11, S12 can be obtained in which the acoustic image localization position in front of the listener has been approximately moved.

Similarly, by thus applying the level difference, by means of the acoustic image localization characteristic application processing unit 32, to the stereo outputs D21, D22 from the digital filter 22 shown in FIG. 3 only in the predetermined frequency band, based on a control signal C2 from the acoustic image localization position control processing unit 8 resulting from instructions from the acoustic image control input unit 9, outputs S21, S22 can be obtained in which the acoustic image localization position behind the listener has been approximately moved.

In the above-described acoustic image localization processing device shown in FIG. 3, means for convolution processing with a pair of impulse responses for one system of input audio signal is prepared, and by providing an acoustic image localization characteristic application processing unit, which applies a time difference, level difference, frequency characteristic or similar to the pair of L channel and R channel outputs of the convolution means according to the acoustic image localization position, a broad range of acoustic image movement positions can be covered merely by preparing a pair of impulse response convolution means; hence acoustic image movement over the entirety of the listener periphery can be realized using data subjected to convolution processing with a small amount of impulse response, without the need to prepare all impulse responses corresponding to each acoustic image movement position.

Next, an acoustic image localization signal processing device of a first embodiment of this invention is explained.

Figure 1:
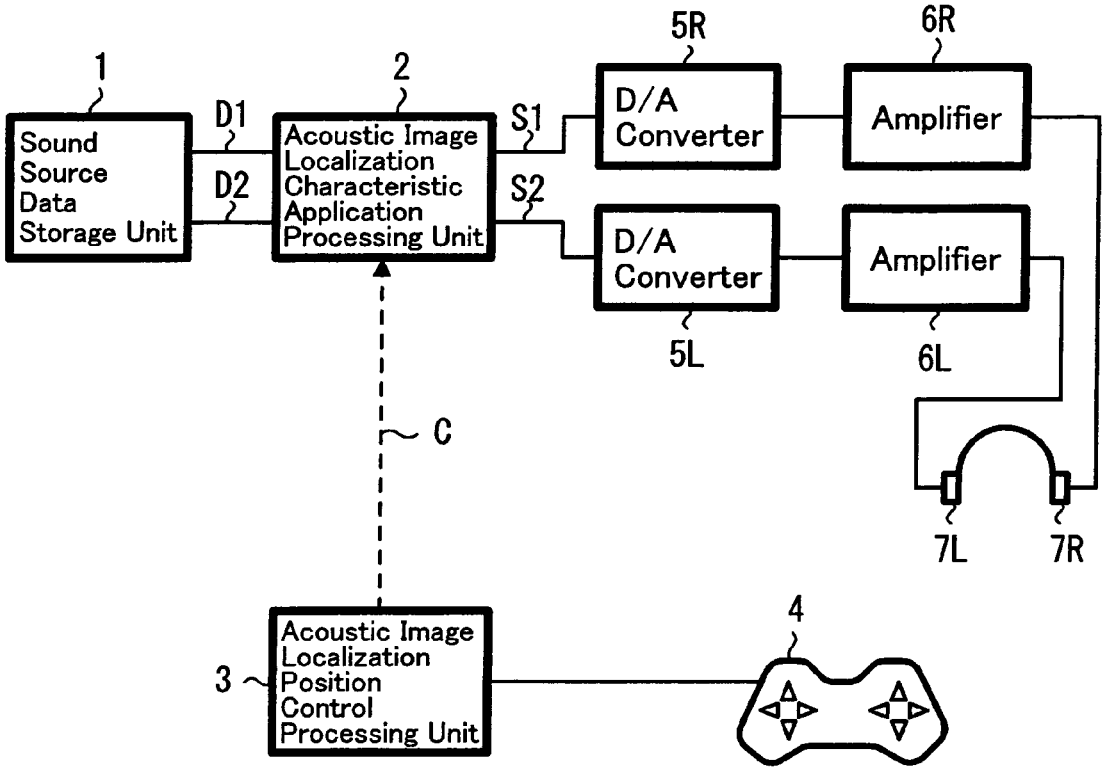
FIG. 1 is a block diagram showing the configuration of an acoustic image localization signal processing device according to an embodiment of this invention.

FIG. 1 is a block diagram showing the configuration of the acoustic image localization signal processing device of this embodiment. The acoustic image localization signal processing device shown in FIG. 1 differs greatly from the above-described acoustic image localization processing device shown in FIG. 3 in that sound source data are subjected to predetermined preprocessing (described below) in advance, and stored on recording media as file or other data.

As described above, in the assumed acoustic image localization processing device shown in FIG. 3, by performing realtime signal processing in the digital filters 21, 22 and the acoustic image localization characteristic application processing units 31, 32, the acoustic image of the input signal I1 can be localized at an arbitrary position in the vicinity of the listener.

In the assumed acoustic image localization processing device shown in FIG. 3, impulse response convolution processing is performed in realtime by the digital filters 21, 22, and acoustic image localization characteristic application processing is performed in realtime by the acoustic image localization characteristic application processing units 31, 32 with respect to the input signal I1.

However, since the impulse responses are comparatively long, and numerous computations of the sums of products are involved, the impulse response convolution processing performed by the digital filters 21, 22 as part of acoustic image localization processing requires a large volume of processing compared with the acoustic image localization characteristic application processing by the acoustic image localization characteristic application processing units 31, 32, and moreover processing time is considerable.

Further, whereas the impulse response convolution processing performed by the digital filters 21, 22 is fixed signal processing in which the convolution with impulse responses determined in advance is computed, the acoustic image localization characteristic application processing by the acoustic image localization characteristic application processing units 31, 32 is signal processing in which characteristics may vary according to the control signal C from the acoustic image localization position control processing unit, resulting from instructions from the acoustic image control input unit.

Hence continuously executing impulse response convolution processing by the digital filters 21, 22 in realtime, and acoustic image localization characteristic application processing by the acoustic image localization characteristic application processing units 31, 32 in realtime, is not efficient.

Thus in the acoustic image localization signal processing device of this embodiment, sound source data are in advance subjected to impulse response convolution processing by digital filters as predetermined preprocessing, and are saved on recording media as file or other data; and acoustic image localization characteristic application processing is performed on this sound source data by an acoustic image localization characteristic application processing unit through control signals from an acoustic image localization position control processing unit, according to instructions from an acoustic image control input unit.

Figure 11:
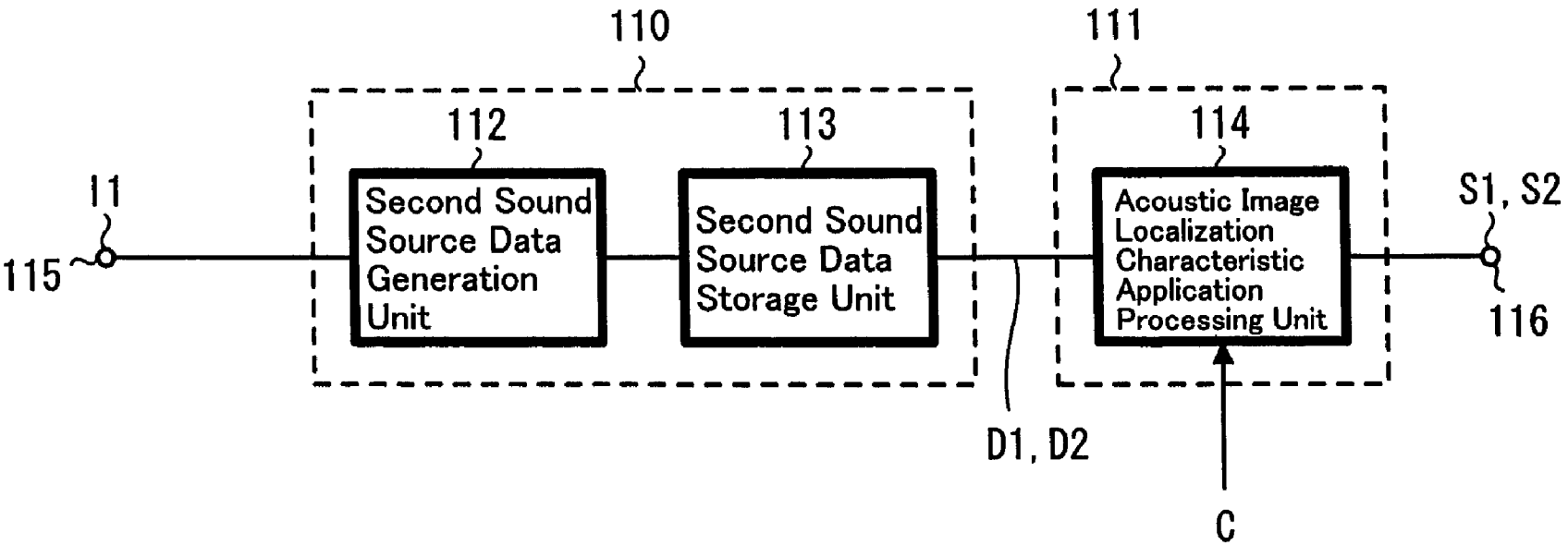
FIG. 11 is a diagram showing a fixed-component signal processing unit and variable-component signal processing unit.

FIG. 11 shows a variable-component signal processing unit, and a fixed-component signal processing unit which supplies sound source data to this variable-component signal processing unit, in the acoustic image localization signal processing device of this embodiment.

In FIG. 11, a fixed-component signal processing unit 110 has a terminal 115, to which the input signal I1 is input as the first sound source data set; a second sound source data generation unit 112, which performs impulse response convolution processing on the input signal I1 as the first sound source data set, to generate the second sound source data set; and a second sound source data storage unit 113, which stores the second sound source data set as file data. For example, the fixed-component signal processing unit 110 performs reverberation application and other processing, in addition to acoustic image localization processing in a reference direction. This reference direction may be, for example, the anterior or posterior direction with respect to the listener.

Further, a variable-component signal processing unit 111 has an acoustic image localization characteristic application processing unit 114, which performs acoustic image localization position control processing on the input signals D1, D2 from the second sound source data storage unit 113 by means of a control signal C from the acoustic image localization position control processing unit 3, and a terminal 116 from which the output signals S1, S2 are output. For example, the variable-component signal processing unit 111 may perform application processing necessary for acoustic image localization in the direction of the acoustic image position moved from the reference direction.

In FIG. 1, a sound source data storage unit 1 stores on recording media as file or other data, second sound source data obtained by performing predetermined preprocessing, that is, convolution processing in advance with impulse response representing the HRTF in the reference direction, using digital filters.

FIG. 4 shows the configuration of the second sound source data generation unit. In FIG. 4, the input signal I1 is input to the digital filters 41, 42 via the terminal 43. The input signal I1 is subjected by the digital filter 41 to impulse response convolution processing representing the HRTF to the left ear in the reference direction, and the resulting output signal D1 is output from the terminal 44. The input signal I1 is also subjected by the digital filter 42 to impulse response convolution processing representing the HRTF to the right ear in the reference direction, and the resulting output signal D2 is output from the terminal 45. The terminal 44 in FIG. 4 corresponds to the side of the output signal D1 shown in FIG. 1, and the terminal 45 in FIG. 4 corresponds to the side of the output signal D2 in FIG. 1.

The digital filters 41, 42 shown in FIG. 4 each comprise the FIR filter shown in FIG. 6. The terminal 43 in FIG. 4 corresponds to the terminal 64 in FIG. 6; the terminal 44 in FIG. 4 corresponds to the terminal 65 in FIG. 6; and the terminal 45 in FIG. 4 corresponds to the terminal 65 in FIG. 6. In FIG. 6, the FIR filter has delay devices 61-1 to 61-n; scalers 62-1 to 62-n+1; and adders 63-1 to 63-n. In the FIR filter shown in FIG. 6, when the listener listens to reproduced sound using headphones, speakers or similar, impulse response convolution processing is performed so as to localize the acoustic image at a position in a reference direction, such as for example the anterior or posterior direction with respect to the listener.

Thus by performing convolution processing with two transfer functions from the position at which the acoustic image is to be localized to both ears of the listener, output signals D1, D2, which are the second stereo sound source data, are obtained.

In cases where the reference direction is the front or posterior direction, the HRTFs to the right and left ears of the listener are the same, and so the digital filters 41, 42 can have the same characteristics. In this case, the input signal I1 may be input to either of the digital filters 41 or 42, and the output signal obtained may be output to the other output terminal 45 or 44.

Next, the two systems of output signals D1, D2 are input to an acoustic image localization characteristic application processing unit 2. When the listener inputs movement information to move the acoustic image position by means of an acoustic image control input unit 4, the acoustic image localization position control unit 3 converts the movement information into angle information or into position information, and using the converted values as parameters, acoustic image localization characteristic application processing is performed on the second stereo sound source data D1, D2 by acoustic image localization application processing unit.

Movement information in two or three dimensions, input from the acoustic image control input unit 4 using for example a pointing device, is converted into data indicating the sound source position, for example orthogonal coordinates indicated by X,Y(,Z), polar coordinates, or other parameter information by the acoustic image localization position control unit 3. Or, movement information programmed by the acoustic image control input unit 4 may be input.

Figure 5:
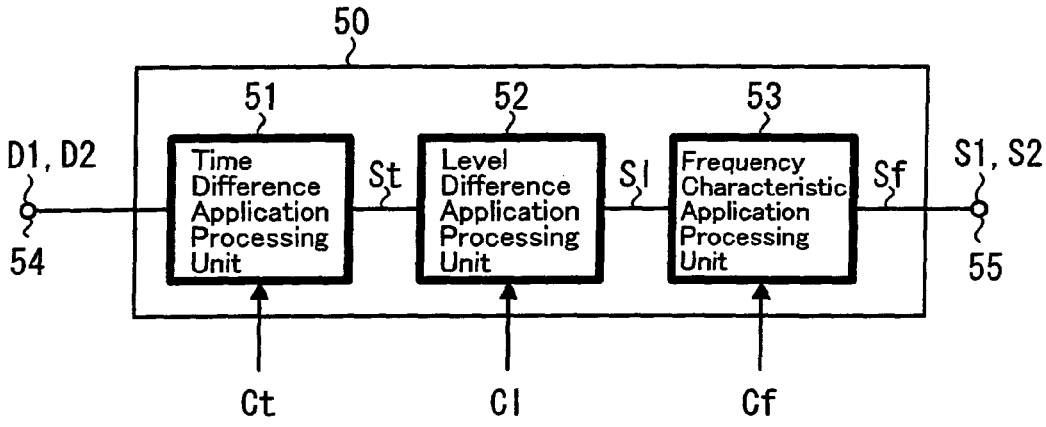
FIG. 5 is a diagram showing an example of the configuration of the acoustic image localization characteristic application processing unit.

As shown in FIG. 5, an acoustic image localization characteristic application processing unit 50 has a time difference application processing unit 51, which applies a time difference to the input signals D1, D2 according to a control signal Ct from the acoustic image localization position control processing unit 3 to output an output signal St; a level difference application processing unit 52, which applies a level difference to the input signals D1, D2 according to a control signal C1 from the acoustic image localization position control processing unit 3 to output an output signal S1; and a frequency characteristic application processing unit 53, which applies a frequency characteristic to the input signals D1, D2 according to a control signal Cf from the acoustic image localization position control processing unit 3 to output an output signal Sf.

The acoustic image localization characteristic application processing unit 50 may be provided with any one among the time difference application processing unit 51, level difference application processing unit 52, or frequency characteristic application processing unit 53; or, may be provided with any two, whether the time difference application processing unit 51 and level difference application processing unit 52, the level difference application processing unit 52 and frequency characteristic application processing unit 53, or the time difference application processing unit 51 and frequency characteristic application processing unit 53. Moreover, this plurality of processes may be performed comprehensively in a single operation.

The terminal 54 shown in FIG. 5 corresponds to the side of the input signals D1, D2 in FIG. 1; and the terminal 55 in FIG. 5 corresponds to the side of the output signals S1, S2 in FIG. 1. When the reference direction is in front or behind the listener, the right and left HRTFs have the same characteristic, and so the input signals D1, D2 are the same. Consequently either of the output signals D1 or D2 of the second sound source data set from the sound source data storage unit 1 shown in FIG. 1 can be retrieved, and supplied to the respective acoustic image localization characteristic application processing units in the unit 50.

Here, if for example parameters modified by acoustic image localization characteristic application processing are direction angle data on the sound source S in the anterior direction of the listener L, and the acoustic image localization characteristic application processing comprises time difference application processing, then by applying time difference characteristics corresponding to the angle as shown in the characteristic of FIG. 12 to the input signals D1, D2 by means of the time difference application processing unit shown in FIG. 7, the acoustic image can be localized at an arbitrary angle.

An example of the configuration of the time difference application processing unit 51 is shown in FIG. 7. In FIG. 7, the time difference is applied to two systems of input signals. The time difference application processing unit of FIG. 7 has a terminal 75; delay devices 71-1 to 71-n; a switch 72; a terminal 76; a terminal 77; delay devices 73-1 to 73-n; a switch 74; and a terminal 78.

The input signal D1 is input to the terminal 75 and is supplied to the delay devices 71-1 to 71-n; and a time difference is applied to the input signal D1 according to the output from the delay devices 71-1 to 71-n selected by the switch 72, to be output from the terminal 76 as the output signal S1*t*.

The input signal D2 is input to the terminal 77 and is supplied to the delay devices 73-1 to 73-n; and a time difference is applied to the input signal D2 according to the output from the delay devices 73-1 to 73-n selected by the switch 74, to be output from the terminal 78 as the output signal S2*t*.

When the time difference applied to the input signal D1 differs from the time difference applied to the input signal D2, a time difference is applied between the output signals S1*t* and S2*t*.

A time difference such as that shown in FIG. 12 occurs in signals arriving at the listener's ears from the sound source, according to the angle from the listener's anterior direction. In FIG. 12, the rotation angle 0° is the state in which the sound source S is positioned in front of the listener L shown in FIG. 16. In FIG. 16, if for example the sound source S is rotated by −90° in the left direction with respect to the listener L, the arrival time of sound arriving at the right ear as indicated by Ta lags behind that from the anterior direction, and the arrival time of sound arriving at the left ear as indicated by Tb is ahead of that from the anterior direction, so that a time difference occurs between the two.

On the other hand, if the sound source S is rotated by +90° in the right direction with respect to the listener L, the arrival time of sound arriving at the right ear as indicated by Ta is ahead of that from the anterior direction, and the arrival time of sound arriving at the left ear as indicated by Tb lags behind that from the anterior direction, so that a time difference occurs between the two.

Returning to FIG. 1, data D2 subjected to convolution with a transfer function based on a control signal Ct from the acoustic image localization position control processing unit 3, according to instructions from the acoustic image control input unit 4, is subjected to application processing such that the above described time difference occurs. By applying such a time difference to the stereo outputs D1, D2 of the second sound source data set from the sound source data storage unit 1 shown in FIG. 1, by means of the acoustic image localization characteristic application processing unit 2, outputs S1, S2 are obtained such that the acoustic image localization position is approximately moved to an arbitrary position with respect to the listener.

As explained above, by employing the acoustic image localization signal processing device of FIG. 1 to perform predetermined preprocessing, that is, convolution processing in advance with an impulse response representing the HRTF in the reference direction using digital filters, and storing the result on recording media as file or other data, and then subjecting this second sound source data 1 to realtime signal processing in the acoustic image localization characteristic application processing unit 2, the acoustic image can be localized at an arbitrary position with respect to the listener.

In the above explanation, an example was described in which the time difference application processing unit shown in FIG. 7 is used as the acoustic image localization characteristic application processing unit 2; but a level difference application processing unit may be further added to the time difference application processing unit. Also, in place of the time difference application processing unit, a level difference application processing unit may be employed.

Here, if for example parameters modified by acoustic image localization characteristic application processing are direction angle data on the sound source S in the anterior direction of the listener L, and the acoustic image localization characteristic application processing comprises level difference application processing, by applying a level difference characteristic corresponding to the angle as shown in the characteristic of FIG. 13 to the input signals D1, D2, by means of the level difference application processing unit shown in FIG. 8, the acoustic image can be localized at an arbitrary angle.

The level difference application processing unit can be configured as shown in FIG. 8. In FIG. 8, the level difference application processing unit has a terminal 83; scaler 81; terminal 84; terminal 85; scaler 82; and terminal 86.

In FIG. 8, the level difference application processing unit updates the level in the scaler 81 with respect to the input signal D1 input from the terminal 83, based on the control signal C1 from the acoustic image localization position control processing unit 3 according to instructions from the acoustic image control input unit 4, and by this means an output signal S11 with a level difference applied is obtained at the terminal 84. In this way, a level difference can be applied to the input signal D1.

Also, the level difference application processing unit updates the level in the scaler 82 with respect to the input signal D2 input from the terminal 85, based on the control signal C2 from the acoustic image localization position control processing unit 3 according to instructions from the acoustic image control input unit 4, and by this means an output signal S21 with a level difference applied is obtained at the terminal 86. In this way, a level difference can be applied to the input signal D2.

As shown in FIG. 16, a level difference as shown in FIG. 13 occurs in the signals arriving at both ears of the listener L from the sound source S, according to the angle from the anterior direction of the listener, which is represented by 0°. In FIG. 13, the rotation angle 0° is the state in which the sound source S is positioned in front of the listener L in FIG. 16. In FIG. 16, if for example the sound source S is rotated by −90° in the left direction with respect to the listener L, the level of sound arriving at the left ear as indicated by Lb is higher than that from the anterior direction, the level of sound arriving at the right ear as indicated by La is lower than that from the anterior direction, and a level difference occurs between the two.

On the other hand, if the sound source S is rotated by +90° in the right direction with respect to the listener L, the level of sound arriving at the left ear as indicated by Lb is lower than that from the anterior direction, the level of sound arriving at the right ear as indicated by La is higher than that from the anterior direction, and a level difference occurs between the two.

Returning to FIG. 1, the data D1, D2 convoluted with transfer functions are subjected to application processing so as to cause a level difference, based on a control signal C1 from the acoustic image localization position control processing unit 3, according to instructions from the acoustic image control input unit 4. By applying this level difference to the stereo output D1, D2 of the second sound source data set from the sound source data storage unit 1 shown in FIG. 1, by means of the acoustic image localization characteristic application processing unit 2, output S1, S2 are obtained in which an arbitrary acoustic image localization position with respect to the listener is approximately moved.

In the above explanation, an example is described in which the level difference application processing unit shown in FIG. 8 is used as the acoustic image localization characteristic application processing unit 2; however, a level difference application processing unit, and/or a frequency characteristic application processing unit, may also be added to be used along with the time difference application processing unit. Further, in place of the level difference application processing unit, a frequency characteristic application processing unit may be used. Also, this plurality of processing may be performed comprehensively in a single operation.

When, for example, parameters which have been modified in acoustic image localization characteristic application processing are direction angle data on the sound source S in the anterior direction of the listener L, and the acoustic image localization characteristic application processing comprises frequency characteristic application processing, by applying the frequency characteristic corresponding to the angle as shown in the characteristic of FIG. 14 to the input signals D1, D2 by means of the frequency characteristic application processing unit shown in FIG. 9, the acoustic image can be localized at an arbitrary angle.

The frequency characteristic application processing unit can be configured as shown in FIG. 9. In FIG. 9, the frequency characteristic application processing unit has a terminal 95; filter 91; terminal 96; terminal 97; filter 93; and terminal 98.

In FIG. 9, the frequency characteristic application processing unit updates the frequency characteristic of the filter 91 based on the control signal Cf from the acoustic image localization position control processing unit 3 according to instructions from the acoustic image control input unit 4, whereby a level difference is applied only in a predetermined frequency band to the input signal D1 input to a terminal 95, to be output from a terminal 96 as the output signal S1*f*. In this way, a level difference can be applied to the input signal D1 only in the predetermined frequency band.

Also, the level difference application processing unit updates the frequency characteristic of the filter 93 based on the control signal C2 from the acoustic image localization position control processing unit 3 according to instructions from the acoustic image control input unit 4, whereby a level difference is applied only in a predetermined frequency band to the input signal D2 input from the terminal 97, to be output from the terminal 98 as the output signal S2*f*. In this way, a level difference can be applied to the input signal D2 only in the predetermined frequency band.

As shown in FIG. 16, in the signal arriving at both ears of the listener L from the sound source S, there is a level difference such as shown in FIG. 14 depending on the frequency band, due to the angle from the anterior direction of the listener L, represented by 0°. In FIG. 14, the rotation angle 0° is the state in which the sound source S is positioned in front of the listener L in FIG. 16. In FIG. 16, if for example the sound source S is rotated by −90° in the left direction with respect to the listener L, the level of sound arriving at the left ear as indicated by fa is higher than that from the anterior direction, and the level of sound arriving at the right ear as indicated by fb is lower than that from the anterior direction, and a level difference occurs in the high-frequency band in particular.

On the other hand, if the sound source S is rotated by +90° in the right direction with respect to the listener L, the level of sound arriving at the left ear as indicated by fb is lower than that from the anterior direction, and the level of sound arriving at the right ear as indicated by fa is higher than that from the anterior direction, and a level difference occurs in the high-frequency band in particular.

Returning to FIG. 1, data D1, D2 convoluted with transfer functions are subjected to application processing so as to cause such a level difference, based on a control signal Cf from the acoustic image localization position control processing unit 3, according to instructions from the acoustic image control input unit 4. By applying this level difference only in the predetermined frequency band to the stereo output D1, D2 of the second sound source data set from the sound source data storage unit 1 shown in FIG. 1, by means of the acoustic image localization characteristic application processing unit 2, output S1, S2 are obtained in which an arbitrary acoustic image localization position with respect to the listener is approximately moved.

In the acoustic image localization signal processing device of this first embodiment, when for example second sound source data comprise the anterior direction or posterior direction of the listener as the reference direction, the acoustic image localization position can be moved within the range ±90° to the right or left with the front or posterior direction as the center, by means of the above-described acoustic image localization characteristic application processing. Hence when, for example, the sound source movement range is required to be only within the half of the vicinity which is in front of the listener, only sound source data for localization in the anterior direction need to be prepared as the second sound source data.

Further, the above-described time difference application processing unit, level difference application processing unit, and frequency characteristic application processing unit can be used simultaneously, and if used in a cascade connection within the acoustic image localization characteristic application processing unit 50, higher-quality acoustic image movement can be realized.

Furthermore, through discretionary application of the desired acoustic image localization characteristic application processing to sound source data, acoustic image localization can be further improved.

[Modified Embodiment]

In the above-described first embodiment, a single reference direction or reference position is set for acoustic image localization, a first sound source data set is subjected to acoustic image localization processing in advance so as to localize the acoustic image in that position or direction, and the obtained second sound source data set is subjected to the desired acoustic image localization characteristic application processing.

In contrast, in this modified embodiment a plurality of acoustic image localization directions or positions are set for the first sound source data set, and the first sound source data set is subjected to acoustic image localization processing in advance to localize the acoustic image in these directions or positions. The plurality of second sound source data sets obtained through this processing are stored in the sound source data storage unit. A separate sound source data storage unit may be provided for each second sound source data set, or all data sets may be stored together in one sound source data storage unit.

When the listener inputs movement information to move the acoustic image position by means of the acoustic image control input unit 4, the movement information is converted into angle information or position information by the acoustic image localization position control unit 3. The second sound source data set with the acoustic image localization direction or position closest to the angle or position obtained by this conversion is selected from the sound source data storage unit. The selected second sound source data set is subjected to acoustic image localization application processing by the acoustic image localization characteristic application processing unit 2.

The signals S1, S2 output from the acoustic image localization characteristic application processing unit 2 are, similarly to the above-described first embodiment, supplied to the D/A converters 5R, 5L for conversion into analog signals, and are amplified by the amplifiers 6R, 6L so that the listener can listen to reproduced sound using the headphones 7R, 7L. By this means, the acoustic image can be localized with high precision in an arbitrary position in the vicinity of the listener.

For example, suppose that the acoustic image localization directions of the first sound source data set are in the front and posterior directions with respect to the listener, then acoustic image localization processing is performed on the first sound source data set to localize the acoustic image in the front and rear, and two sets of second sound source data are formed and stored in advance in the sound source data storage unit.

If the desired final direction for acoustic image localization by the acoustic image localization position control unit 3 is within the range of the front half of the vicinity of the listener, the second sound source data set to localize the acoustic image in the anterior direction is selected, and then the acoustic image localization characteristic application processing unit 2 performs acoustic image localization application processing. On the other hand, if the desired final direction for acoustic image localization is within the range of the rear half of the vicinity of the listener, then the acoustic image localization position control unit 3 selects the other second sound source data set to localize the acoustic image in the posterior direction, and the acoustic image localization characteristic application processing unit 2 performs acoustic image localization application processing.

In cases where, as in this modified embodiment, the acoustic image localization direction of the first sound source data set is set to the anterior or posterior direction, the HRTFs from the sound source to the listener's right and left ears are equal, as explained above, and so there is no need to store stereo data as second sound source data; one of the stereo sound source data set is stored, and in the acoustic image localization characteristic application processing unit 2 a pair of reproduction signals to which a time difference, level difference, frequency characteristic difference, or similar is applied can be obtained. In this case, the storage capacity of the sound source data storage unit which stores the second sound source data needs not be large, and processing necessary to read the second sound source data is alleviated, so that fewer resources are required.

Next, an acoustic image localization signal processing device of a second embodiment of this invention is explained.

Figure 2:
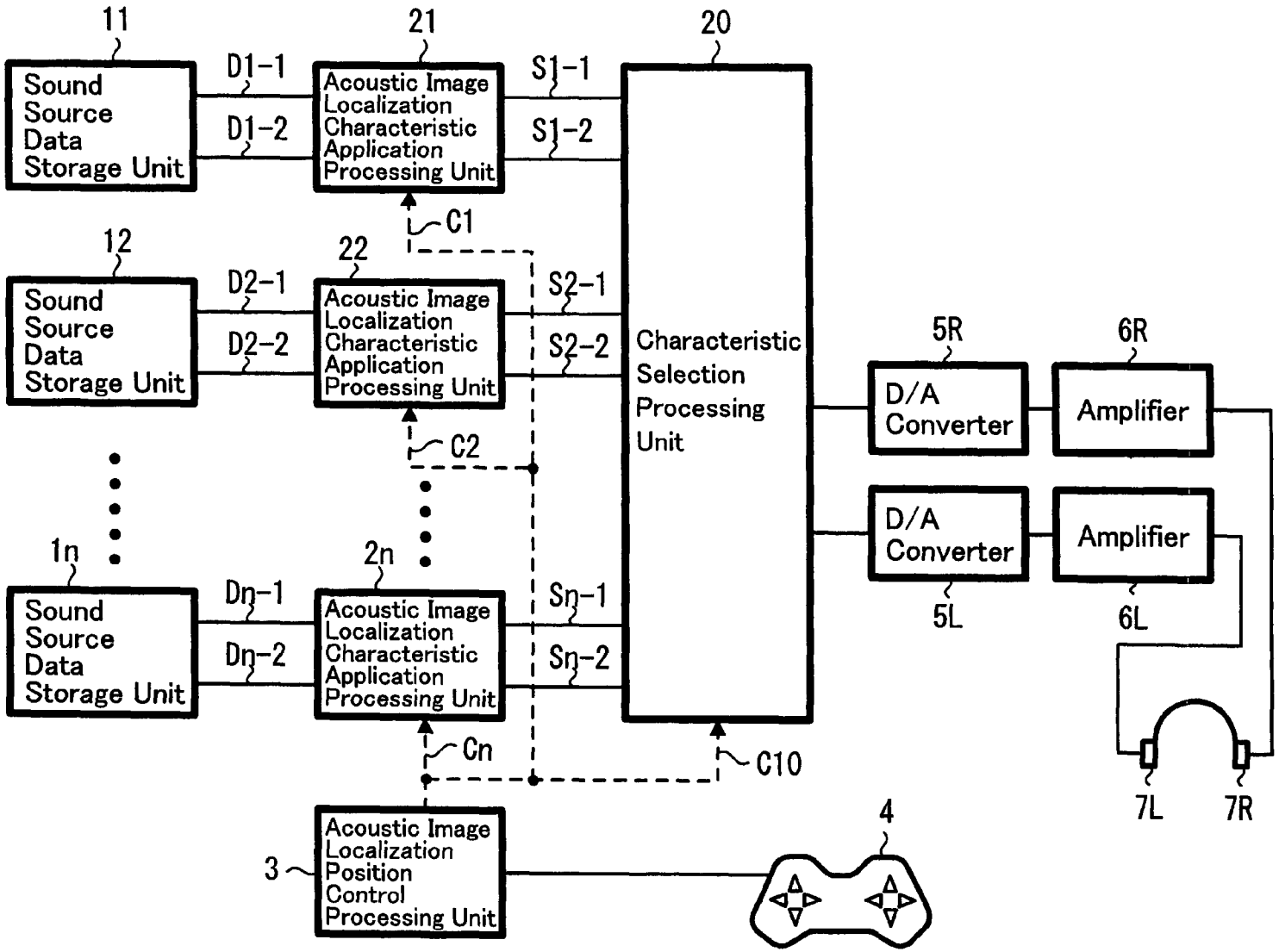
FIG. 2 is a block diagram showing the configuration of an acoustic image localization signal processing device according to another embodiment of this invention.

FIG. 2 is a block diagram showing the configuration of another acoustic image localization signal processing device. FIG. 2 is a block diagram showing the configuration of this acoustic image localization signal processing device. The acoustic image localization signal processing device shown in FIG. 2 differs greatly from the above-described acoustic image localization processing device of FIG. 3 in that sound source data are stored, after subjected to predetermined preprocessing in advance, on recording media in a plurality of files or other data sets so as to be localized in different acoustic image positions.

In this acoustic image localization signal processing device, as the predetermined preprocessing, the original first sound source data set is subjected to convolution processing, by digital filters, with impulse responses representing a plurality of HRTFs from different acoustic image localization positions, and the result is stored as files or other data sets on recording media as a plurality of second sound source data sets. These second sound source data sets are subjected to acoustic image localization characteristic application processing by an acoustic image localization characteristic application processing unit, through control signals from an acoustic image localization position control processing unit, according to instructions from an acoustic image control input unit.

FIG. 11 shows a variable-component signal processing unit in this acoustic image localization signal processing device, and a fixed-component signal processing unit which supplies sound source data to this variable-component signal processing unit.

In FIG. 11, the fixed-component signal processing unit 110 has the terminal 115 to which the input signal I1 is input as the first sound source data set; the second sound source data generation unit 112, which performs impulse response convolution processing on the input signal I1 as the first sound source data set, to generate second sound source data; and the second sound source data storage unit 113, which stores the second sound source data as file data.

The variable-component signal processing unit 111 has the acoustic image localization characteristic application processing unit 114, which performs acoustic image localization position control processing on input signals D1, D2 from the second sound source data storage unit 113, through a control signal C from the acoustic image localization position control processing unit 3, and a terminal 116 from which the output signals S1, S2 are output.

In this acoustic image localization signal processing device, a plurality of the fixed-component signal processing units 110 and variable-component signal processing units 111 of FIG. 11 are provided, corresponding to a plurality of sound source data sets 11 to in indifferent acoustic image positions.

In FIG. 2, the second sound source data sets in the sound source data storage units 11 to 1*n* are obtained by subjecting in advance the first sound source data set to convolution processing with impulse responses representing the HRTFs from different acoustic image localization positions, as the predetermined preprocessing, and are stored as file or other data on recording media. Accordingly, a plurality of second sound source data sets are formed for a single first sound source data set.

FIG. 4 shows the configuration of the second sound source data generation unit. In FIG. 4, the input signals I11 to I1*n* are input via the terminal 43 to the digital filters 41, 42. The input signals I11 to I1*n* are subjected to convolution processing by the digital filter 41 with impulse responses representing the HRTFs from sound sources in different acoustic image positions to the left ear of the listener, and the results are output to the terminal 44 as the output signals D1-1, D2-1, . . . , Dn-1. The input signals I11 to I1*n* are also subjected to convolution processing by the digital filter 42 with impulse responses representing the HRTFs from sound sources with different acoustic image positions to the right ear of the listener, and the results are output to the terminal 45 as the output signals D1-2, D2-2, . . . , Dn-2. The terminal 44 in FIG. 4 corresponds to the side of the output signals D1-1, D2-1, . . . , Dn-1 in FIG. 2, and the terminal 45 in FIG. 4 corresponds to the side of the output signals D1-2, D2-2, . . . , Dn-2 in FIG. 2.

The digital filters 41, 42 shown in FIG. 4 each comprise the FIR filter shown in FIG. 6. The terminal 43 in FIG. 4 corresponds to the terminal 64 in FIG. 6; the terminal 44 in FIG. 4 corresponds to the terminal 65 in FIG. 6; and the terminal 45 in FIG. 4 similarly corresponds to the terminal 65 in FIG. 6. In FIG. 6, the FIR filter has delay devices 61-1 to 61-n, scalers 62-1 to 62-n+1, and adders 63-1 to 63-n. When the listener listens to sound reproduced by headphones, speakers or similar, convolution processing with impulse response from the sound sources in different acoustic image positions is performed in the FIR filter of FIG. 6, to localize the acoustic image in the respective sound source positions.

In this second embodiment, a plurality of the second sound source data generation units shown in FIG. 4 are provided to correspond to the plurality of sound source data sets 11 to 1*n*, each in different acoustic image positions.

By performing convolution processing with transfer functions on two systems, from the position at which the acoustic image is to be localized to both the ears of the listener, the output signals D1-1, D1-2, D2-1, D2-2, . . . , Dn-1, Dn-2, which are the second stereo sound source data sets, are obtained, and these are stored in the respective sound source data storage units 11 to 1*n*.

Next, the two systems of output signals D1-1, D1-2, D2-1, D2-2, . . . , Dn-1, Dn-2 retrieved from the sound source data storage units 11 to in are input to the acoustic image localization characteristic application processing units 21 to 2*n*. When the listener uses the acoustic image control input unit 4 to input movement information in order to move the acoustic image position, the acoustic image localization position control unit 3 converts the movement information into angle information or into position information, and using the converted values as parameters, performs acoustic image localization application processing on the second stereo acoustic image data sets D1-1, D1-2, D2-1, D2-2, . . . , Dn-1, Dn-2 by means of the acoustic image localization characteristic application processing unit.

As shown in FIG. 5, the acoustic image localization characteristic application processing unit 50 comprises the time difference application processing unit 51, which applies a time difference, based on a control signal C1 from the acoustic image localization position control processing unit 3, to the input signals D1-1, D1-2, D2-1, D2-2, . . . , Dn-1, Dn-2, and outputs output signals St; the level difference application processing unit 52, which applies a level difference, based on a control signal C1 from the acoustic image localization position control processing unit 3, to the input signals D1-1, D1-2, D2-1, D2-2, . . . , Dn-1, Dn-2, and outputs output signals St; and the frequency characteristic application processing unit 53, which applies a frequency characteristic, based on a control signal Cf from the acoustic image localization position control processing unit 3, to the input signals D1-1, D1-2, D2-1, D2-2, . . . , Dn-1, Dn-2, and outputs output signals Sf.

In the acoustic image localization characteristic application processing unit 50, any one among the time difference application processing unit 51, level difference application processing unit 52, or frequency characteristic application processing unit 53 may be provided; or, any two among these, namely the time difference application processing unit 51 and level difference application processing unit 52, or the level difference application processing unit 52 and frequency characteristic application processing unit 53, or the time difference application processing unit 51 and frequency characteristic application processing unit 53, may be provided. Moreover, this plurality of processes may be performed comprehensively in a single operation.

The terminal 54 shown in FIG. 5 corresponds to the side of the input signals D1-1, D1-2, D2-1, D2-2, . . . , Dn-1, Dn-2 in FIG. 2, and the terminal 55 of FIG. 5 corresponds to the side of the output signals S1-1, S1-2, S2-1, S2-2, . . . , Sn-1, Sn-2 in FIG. 2. If the input signals D1-1, D1-2, D2-1, D2-2, . . . , Dn-1, Dn-2 are mutually corresponding, for example when acoustic image localization positions are in lateral symmetry, one each among the input signals D1-1, D2-1, . . . , Dn-1 or D1-2, D2-2, . . . , Dn-2 may be used in common.

In this acoustic image localization signal processing device, a plurality of the acoustic image localization characteristic application processing units 50 shown in FIG. 5 are provided to correspond to a plurality of sound source data sets 11 to 1*n* in different positions. Also, the above characteristic application processing is performed on the output signals D1-1, D1-2, D2-1, D2-2, . . . , Dn-1, Dn-2.

Here, when for example parameters modified in acoustic image localization characteristic application processing are direction angle data on the sound source S in the anterior direction of the listener L, and acoustic image localization characteristic application processing comprises time difference application processing, by applying time difference characteristics corresponding to angles as the characteristic shown in FIG. 12, by means of time difference application processing unit as shown in FIG. 7, to the input signals D1-1, D1-2, D2-1, D2-2, . . . , Dn-1, Dn-2, the acoustic image can be localized at an arbitrary angle.

In this acoustic image localization signal processing device, a plurality of the time difference application processing units shown in FIG. 7 are provided to correspond to a plurality of sound source data sets 11 to 1*n* indifferent acoustic image positions.

An example of the configuration of the time difference application processing unit 51 is illustrated in FIG. 7. In FIG. 7, time differences are applied to two input signal systems. The time difference application processing units in FIG. 7 have a terminal 75, delay devices 71-1 to 71-n, switch 72, terminal 76, terminal 77, delay devices 73-1 to 73-n, switch 74, and terminal 78.

The input signals D1-1, D2-1, . . . , Dn-1 are input to the terminal 75 and are supplied to the delay devices 71-1 to 71-n; a time difference according to the output selected from the delay devices 71-1 to 71-n by the switch 72 is applied, and output signals S1*t* are output from the terminal 76.

The input signals D1-2, D2-2, . . . , Dn-2 are input to the terminal 77 and are supplied to the delay devices 73-1 to 73-n; a time difference corresponding to the output selected from the delay devices 73-1 to 73-n by the switch 74 is applied, and output signals S2*t* are output from the terminal 78.

If the time difference applied to the input signals D1-1, D2-1, . . . , Dn-1 and the time difference applied to the input signals D1-2, D2-2, . . . , Dn-2 are different, then a time difference is applied between the output signals S1*t* and S2*t*.

In the signals arriving at the two ears of the listener from the sound source, there is a time difference as shown in FIG. 12, depending on the angle from the anterior direction with respect to the listener. In FIG. 12, a rotation angle of 0° is a state in which the sound source S is positioned in front of the listener L in FIG. 16. In FIG. 16, if, for example, the sound source S is rotated by −90° in the left direction with respect to the listener L, the arrival time of sound arriving at the right ear as indicated by Ta lags behind that from the anterior direction, and the arrival time of sound arriving at the left ear as indicated by Tb is ahead of that from the anterior direction, so that a time difference occurs between the two.

On the other hand, if the sound source S is rotated by +90° in the right direction with respect to the listener L, the arrival time of sound arriving at the right ear as indicated by Ta is ahead of that from the anterior direction, and the arrival time of sound arriving at the left ear as indicated by Tb lags behind that from the anterior direction, so that a time difference occurs between the two.

Returning to FIG. 2, the data D1-1, D1-2 convoluted with transfer functions are subjected to application processing to cause such a time difference to occur, based on the control signal C1 (Ct) from the acoustic image localization position control processing unit 3 according to instructions from the acoustic image control input unit 4. By applying such a time difference to the stereo output D1-1, D1-2 of the second sound source data sets from the sound source data storage unit 11 shown in FIG. 2, by means of the acoustic image localization characteristic application processing unit 21, outputs S1-1, S1-2 are obtained in which the acoustic image localization position is approximately moved to an arbitrary position selected by the listener.

Similarly, by applying a time difference to the stereo output D2-1, D2-2, . . . , Dn-1, Dn-2 of the second sound source data sets from the sound source data storage units 12 to in shown in FIG. 2, by means of the acoustic image localization characteristic application processing units 22 to 2*n*, based on the control signals C2 to Cn (Ct) from the acoustic image localization position control processing unit 3 according to instructions from the acoustic image control input unit 4, outputs S2-1, S2-2, . . . , Sn-1, Sn-2 are obtained in which the acoustic image localization position is approximately moved to an arbitrary position selected by the listener.

When movement information to move the acoustic image position is input from the acoustic image control input unit 4, the acoustic image localization position control processing unit 3 converts this movement information into angle information or into position information, and with the converted values as parameters, supplies the data to the acoustic image localization characteristic application processing units 21 to 2*n* and to a characteristic selection processing unit 20. In the characteristic selection processing unit 20, data in an acoustic image position close to the angle information or position information are selected from among the stereo sound source data D1-1, D1-2, D2-1, D2-2, . . . , Dn-1, Dn-2, and characteristics are applied to the selected stereo sound source data D1-1, D1-2, D2-1, D2-2, . . . , Dn-1, Dn-2 by the acoustic image localization characteristic application processing units 21 to 2*n*.

The characteristic selection processing unit 20 supplies the output to the D/A converts 5R, 5L to convert the output into analog signals, and after amplified by the amplifiers 6R, 6L, the listener can listen to sound reproduced by the headphones 7R, 7L. By this means, the acoustic image can be localized with high precision in a position arbitrarily selected by the listener.

The characteristic selection processing unit 20 shown in FIG. 2 can be configured, for example, as shown in FIG. 10.

In FIG. 10, two input signal systems are shown; however, in this embodiment a plurality of inputs systems corresponding to the input signals S1-1, S2-1, S2-2, . . . , Sn-1, Sn-2 can be configured.

In FIG. 10, the characteristic selection processing unit 20 has terminals 104, 105, to which the input signals S1-1 s1-2 are input; scalers 101-1, 101-2; adders 103-1, 103-2; terminals 106, 107, to which the input signals S2-1, S2-2 are input; scalers 102-1, 102-2; and terminals 108, 109, from which the output signals S10-1, S10-2 are output.

In FIG. 10, when the acoustic image localization position is intermediate between the acoustic image position corresponding to the input signals S1-1, S1-2 and the acoustic image position corresponding to the input signals S2-1, S2-2, the coefficients of the scalers 101-1, 101-2, 102-1, and 102-2 are set to 0.5, and the input signals S1-1 and S2-1, and the input signals S1-2 and S2-2 are respectively mixed and output. When the acoustic image localization position is closer to the acoustic image position corresponding to the input signals S1-1, S1-2 than to the acoustic image position corresponding to the input signals S2-1, S2-2, mixing is performed such that the proportion of the input signals S1-1, S1-2 is relatively greater, and the result is output. Further, if the acoustic image localization position moves such as passing through the above intermediate position, by gradually reducing the output signals S10-1-1, S10-1-2 in the scalers 101-1, 101-2 and gradually increasing the output signals S10-2-1, S10-2-2 in the scalers 102-1, 102-2, or on the other hand by gradually increasing the output signals S10-1-1, S10-1-2 in the scalers 101-1, 101-2 and gradually reducing the output signals S10-2-1, S10-2-2 in the scalers 102-1, 102-2, cross-fade processing is performed. By this means, smooth data switching can be performed even when the acoustic image moves between sound source localization positions corresponding to the plurality of stereo sound source data sets obtained by performing acoustic image localization characteristic application processing.

As explained above, in the acoustic image localization signal processing device shown in FIG. 2, digital filters are used to perform in advance convolution processing with impulse responses representing the HRTF in the reference direction as predetermined preprocessing, and the resulting second sound source data sets 11 to 1*n* corresponding to sound sources in different acoustic image positions are stored on recording media as file or other data; by performing signal processing on these data in realtime in the acoustic image localization characteristic application processing units 21 to 2n, the acoustic images can be localized with high precision in arbitrary positions selected by the listener.

In the above-described explanation, an example is shown in which the time difference application processing unit shown in FIG. 7 is used as the acoustic image localization characteristic application processing units 21 to 2*n*; but a level difference application processing unit may also be added to the time difference application processing unit. Further, a level difference application processing unit may be used in place of the time difference application processing unit.

In cases where for example parameters modified by the acoustic image localization characteristic application processing are direction angle data on the sound source S in the anterior direction of the listener L, and acoustic image localization characteristic application processing comprises level difference application processing, by using the level difference application processing unit shown in FIG. 8 to apply the level difference characteristic corresponding to angles as in the characteristic of FIG. 13 to the input signals D1-1, D1-2, D2-1, D2-2, . . . , Dn-1, Dn-2, an acoustic image can be localized at an arbitrary angle.

The level difference application processing unit can be configured as shown in FIG. 8. In FIG. 8, the level difference application processing unit has a terminal 83; scaler 81; terminal 84; terminal 85; scaler 82; and terminal 86.

In this acoustic image localization signal processing device, a plurality of the level difference application processing units shown in FIG. 8 are provided, corresponding to the plurality of sound source data sets 11 to 1*n* in different positions. The above-described characteristic application processing is performed on the output signals D1-1, D1-2, D2-1, D2-2, . . . , Dn-1, Dn-2.

In FIG. 8, the level difference application processing unit updates the level in the scaler 81 with respect to the input signals D1-1, D2-1, . . . , Dn-1 input from the terminal 83, based on the control signals C1 to Cn (C1) from the acoustic image localization position control processing unit 3 according to instructions from the acoustic image control input unit 4, whereby an output signal S1 with level difference applied is obtained at the terminal 84. In this way, level differences can be applied to the input signals D1-1, D2-1, . . . , Dn-1.

Also, the level difference application processing unit updates the level in the scaler 82 with respect to the input signals D1-2, D2-2, . . . , Dn-2 input from the terminal 85, based on the control signals C1 to Cn (C1) from the acoustic image localization position control processing unit 3 according to instructions from the acoustic image control input unit 4, whereby an output signal S21 with level difference applied is obtained at the terminal 86. In this way, level differences can be applied to the input signals D1-2, D2-2, . . . , Dn-2.

As shown in FIG. 16, in signals arriving at the two ears of the listener L from the sound source S, there is a level difference such as that shown in FIG. 13, according to the angle from the anterior direction of the listener L, represented by 0°. In FIG. 13, a 0° rotation angle is the state in which the sound source S is positioned in front of the listener L in FIG. 16. In FIG. 16, if for example the sound source S is rotated by −90° in the left direction with respect to the listener L, the level of sound arriving at the left ear as indicated by Lb is higher than that from the anterior direction, and the level of sound arriving at the right ear as indicated by La is lower than that from the anterior direction, so that a level difference occurs between the two.

On the other hand, if the sound source S is rotated by +90° in the right direction with respect to the listener L, the level of sound arriving at the left ear as indicated by Lb is lower than that from the anterior direction, and the level of sound arriving at the right ear as indicated by La is higher than that from the anterior direction, so that a level difference occurs between the two.

Returning to FIG. 2, data convoluted with transfer functions are subjected to application processing to cause such a level difference to occur, based on the control signals C1 to Cn (C1) from the acoustic image localization position control processing unit 3 according to instructions from the acoustic image control input unit 4. By applying such a level difference to the stereo output D1-1, D1-2, D2-1, D2-2, . . . , Dn-1, Dn-2 of the second sound source data sets from the sound source data storage units 11 to 1*n* shown in FIG. 2, by means of the acoustic image localization characteristic application processing units 21 to 2*n*, outputs S1-1, S1-2, S2-1, S2-2, . . . , Sn-1, Sn-2 are obtained in which the acoustic image localization position is approximately moved to an arbitrary position selected by the listener.

In the above explanation, an example is described in which the level difference application processing unit shown in FIG. 8 is used as the acoustic image localization characteristic application processing units 21 to 2*n*; however, a level difference application processing unit, and/or a frequency characteristic application processing unit, may also be added to the time difference application processing unit. Further, in place of the level difference application processing unit, a frequency characteristic application processing unit may be used. Also, this plurality of processes may be performed comprehensively in a single operation.

When, for example, parameters modified in acoustic image localization characteristic application processing are direction angle data on the sound source S in the anterior direction of the listener L, and the acoustic image localization characteristic application processing comprises frequency characteristic application processing, by applying the frequency characteristic corresponding to the angle as in the characteristic shown in FIG. 14, by means of the frequency characteristic application processing unit shown in FIG. 9, to the input signals D1-1, D1-2, D2-1, D2-2, . . . , Dn-1, Dn-2, the acoustic image can be localized at an arbitrary angle.

The frequency characteristic application processing unit can be configured as shown in FIG. 9. In FIG. 9, the frequency characteristic application processing unit has a terminal 95; filter 91; scaler 92; terminal 96; terminal 97; filter 93; scaler 94; and terminal 98.

In this acoustic image localization signal processing device, a plurality of the frequency characteristic application processing units shown in FIG. 9 are provided, corresponding to the plurality of sound source data sets 11 to in indifferent positions. The above-described characteristic application processing is performed on the output signals D1-1, D1-2, D2-1, D2-2, . . . , Dn-1, Dn-2.

In FIG. 9, the frequency characteristic application processing unit updates the frequency characteristic in the filter 91, based on the control signals C1 to Cn (Cf) from the acoustic image localization position control processing unit 3 according to instructions from the acoustic image control input unit 4, whereby the input signals D1-1, D2-1, . . . , Dn-1 input from the terminal 95 with a level difference applied only in a predetermined frequency band are output as signals S1f at the terminal 96. In this way, level differences can be applied to the input signals D1-1, D2-1, . . . , Dn-1 only in the predetermined frequency band.

Also, the frequency characteristic application processing unit updates the frequency characteristic in the filter 93, based on the control signals C1 to Cn (Cf) from the acoustic image localization position control processing unit 3 according to instructions from the acoustic image control input unit 4, whereby the input signals D1-2, D2-2, . . . , Dn-2 input from the terminal 97 with a level difference applied only in a predetermined frequency band are output as signals S2*f* at the terminal 98. In this way, level differences can be applied to the input signals D1-2, D2-2, . . . , Dn-2 only in the predetermined frequency band.

As shown in FIG. 16, in signals arriving at the two ears of the listener L from the sound source S, there is a level difference such as that shown in FIG. 14 depending on the frequency band, according to the angle from the anterior direction of the listener L, represented by 0°. In FIG. 14, a rotation angle 0° is the state in which the sound source S is positioned in front of the listener L in FIG. 16. In FIG. 16, if for example the sound source S is rotated by −90° in the left direction with respect to the listener L, the level of sound arriving at the left ear as indicated by fa is higher than that from the anterior direction, and the level of sound arriving at the right ear as indicated by fb is lower than that from the anterior direction. In particular, this level difference occurs in the high-frequency band.

On the other hand, if the sound source S is rotated by +90° in the right direction with respect to the listener L, the level of sound arriving at the left ear as indicated by fb is lower than that from the anterior direction, and the level of sound arriving at the right ear as indicated by fa is higher than that from the anterior direction. In particular, this level difference occurs in the high-frequency band.

Returning to FIG. 2, data convoluted with transfer functions are subjected to application processing to cause such a level difference to occur, based on the control signals C1 to Cn (Cf) from the acoustic image localization position control processing unit 3 according to instructions from the acoustic image control input unit 4. By applying such a level difference to the stereo output D1-1, D1-2, D2-1, D2-2, . . . , Dn-1, Dn-2 of the second sound source data sets from the sound source data storage units 11 to in shown in FIG. 2, by means of the acoustic image localization characteristic application processing units, output S1-1, S1-2, S2-1, S2-2, . . . , Sn-1, Sn-2 is obtained in which the acoustic image localization position is approximately moved to an arbitrary position selected by the listener.

Accordingly, it is possible to simultaneously use a time difference application unit, level difference application unit, and frequency characteristic application unit; and on using the units in a cascade connection within the acoustic image localization characteristic application processing unit 50, acoustic image movement with improved quality can be obtained.

Moreover, by applying the desired acoustic image localization characteristic application processing to sound source data, acoustic image localization can be further improved.

In the above embodiments, examples are described in which time difference application processing, level difference application processing and/or frequency characteristic application processing are performed in the acoustic image localization characteristic application processing unit 50; however, other acoustic image localization characteristic application processing may be performed as well.

Further, in the above-described embodiments, the above second sound source data may be provided on CD-ROM discs, semiconductor memory, or in other forms for use in video game equipment and personal computers; in addition, this data may also be provided over the Internet or some other communication channel. Data may also be stored in a storage device (memory, hard disk drive, or similar) comprised within the acoustic image localization signal processing device of this invention.

INDUSTRIAL APPLICABILITY

This invention can be utilized in, for example, video game equipment (television game equipment) or similar which displays images on a television receiver, and causes images to move according to instructions input by input means.

The invention claimed is:

1. An acoustic image localization signal processing device, comprising:

a sound source data storage unit storing second sound source data obtained by signal processing of first sound source data such that an acoustic image of said first sound source data is localized in one of a reference direction and a reference position;

localization information control means receiving movement information for moving the acoustic image of said first sound source data and providing one of an acoustic image localization direction and an acoustic image localization position of said first sound source data with respect to one of said reference direction and said reference position based on the movement information; and, acoustic image localization characteristic application means applying an acoustic image localization characteristic to said second sound source data read from said sound source data storage unit based on one of the acoustic image localization direction and acoustic image localization position provided by said localization information control means;

wherein processing to apply an acoustic image localization characteristic to second sound source data by said acoustic image localization characteristic application means is processing, in which a pair of output signals are obtained by applying at least two characteristic differences including a time difference and either a level difference or a frequency characteristic difference to the second sound source data.

2. The acoustic image localization signal processing device according to claim 1, wherein said second sound source data comprise a pair of sound source data obtained by performing acoustic image localization processing on said first sound source data, based on head related transfer functions from a virtual sound source in one of said reference direction and reference position to both ears of a listener.

3. The acoustic image localization signal processing device according to claim 1, wherein one of said reference direction and reference position is one of an anterior and posterior direction or position with respect to a listener.

4. The acoustic image localization signal processing device according to claim 1, wherein said movement information is provided to said localization information control means in accordance with an operation by a listener.

5. The acoustic image localization signal processing device according to claim 1, further comprising a localization information storage unit storing one of the acoustic image localization direction and acoustic image localization position for second sound source data, wherein said localization information control means controls said acoustic image localization characteristic application means, based on one of said acoustic image localization direction and acoustic image localization position read from said localization information storage unit.

6. An acoustic image localization signal processing device, comprising:

a sound source data storage unit storing a plurality of second sound source data sets obtained by performing signal processing on a first sound source data set such that acoustic images are localized in a plurality of different directions/positions;

localization information control means receiving movement information for moving the acoustic image of said first sound source data set and providing localization information representing one of an acoustic image localization direction and an acoustic image localization position of said first sound source data set based on the movement information; and acoustic image localization characteristic application means applying an acoustic image localization characteristic to one data set among said plurality of second sound source data sets read from said sound source data storage unit based on the localization information provided by said localization information control means;

wherein processing to apply an acoustic image localization characteristic to second sound source data by said acoustic image localization characteristic application means is processing, in which a pair of output signals are obtained by applying at least two characteristic differences including a time difference and either a level difference or a frequency characteristic difference to the second sound source data.

7. The acoustic image localization signal processing device according to claim 6, wherein said plurality of second sound source data sets have at least anterior sound source data that localizes an acoustic image in an anterior direction from the listener, and posterior sound source data that localizes an acoustic image in a posterior direction.

* * * * *